US005117259A

United States Patent [19]

Etou et al.

[11] Patent Number: 5,117,259

[45] Date of Patent: May 26, 1992

[54] APPARATUS FOR MEASURING DEVELOPER DENSITY

[75] Inventors: Kouichi Etou, Toyokawa; Naoyoshi Kinoshita, Aichi; Hideo Kitakubo, Toyokawa, all of Japan

[73] Assignee: Minolta Camera Kabushiki Kaisha, Osaka, Japan

[21] Appl. No.: 699,701

[22] Filed: May 14, 1991

[30] Foreign Application Priority Data

May 15, 1990 [JP] Japan ..... 2-124664
May 15, 1990 [JP] Japan ..... 2-124665
Oct. 31, 1990 [JP] Japan ..... 2-296515

[51] Int. Cl.[5] ..... G03G 15/09

[52] U.S. Cl. ..... 355/203; 355/246; 118/691

[58] Field of Search ..... 355/203, 208, 246; 118/691

[56] References Cited

U.S. PATENT DOCUMENTS 4,266,141 5/1981 Hirakura et al. ..... 118/691 X

FOREIGN PATENT DOCUMENTS 60-80879 5/1985 Japan ..... 355/246
60-159872 8/1985 Japan .
60-220374 11/1985 Japan .
61-212868 9/1986 Japan .
63-177173 7/1988 Japan .
63-178276 7/1988 Japan ..... 355/246
63-208075 8/1988 Japan ..... 355/246
1-105973 4/1989 Japan ..... 355/246

*Primary Examiner*—Joan H. Pendegrass
*Attorney, Agent, or Firm*—Willian Brinks Olds Hofer Gilson & Lione

[57] ABSTRACT

Apparatus for measuring developer density comprising, a container containing a developer constituted by a toner and a carrier, a rotary member agitating the developer in the container with its rotation, a transparent detection window facing the container, and having an electrically conductive film on its surface facing the developer, a measuring section measuring developer density in container on the basis of reflected light from developer illuminated through the detection window, an electrode which is supported by the rotary member, and is rotated together with the rotary member such that a gap between the electrode and the detection window is maintained at a predetermined value, the electrode being made, at least at one portion facing the detection window, of electrically conductive material, at least one magnet which is supported by the electrode, retains the developer, so that the magnet makes the developer to be brought into contact with the detection window with rotation of the rotary member, and a bias application member for applying bias between the detection window and the electrode so as to make the detection window and the toner electrically repulsive to each other.

4 Claims, 18 Drawing Sheets

APPARATUS FOR MEASURING DEVELOPER DENSITY

FIELD OF THE INVENTION

The present invention relates to an apparatus for measuring developer density by using an optical means in a development apparatus in which a powder developer constituted by a toner and a carrier is contained.

BACKGROUND OF THE INVENTION

In an image forming device which uses a powder developer constituted by a toner and a carrier, measurement of developer density, namely, a weight mixture ratio of the toner to the carrier (hereinafter, referred to as "toner density"), needs to be performed, further the toner needs to be replenished based on a measured value so as to keep a density of an image properly.

Therefore, conventionally, as a method of measurement for the toner density, an optical measurement method is proposed in which the developer in a developer agitator section is illuminated through a transparent detection window, and the toner density in the developer is measured from quantity of reflected light from the developer.

However, in this optical measurement method, there is a disadvantage that real toner density in the developer can not be measured when the developer adheres onto the detection window.

Further, the measured value varies with variations of amount and bulk density of developer coming into contact with the detection window. In other words, there is a disadvantage that the measured value may indicate improper developer density in consequence of the variations, even if real density is proper.

SUMMARY OF THE INVENTION

Accordingly, an essential object of the present invention is to provide apparatus for measuring a developer density by using an optical means in a development apparatus, which eliminates the above described disadvantages inherent in the conventional apparatuses.

In accomplishing these and other objects, according to one preferred embodiment of the invention, there is provided an apparatus for measuring developer density comprising, a container containing a developer constituted by a toner and a carrier, a rotary member agitating the developer in the container with its rotation, a transparent detection window facing to the container, and having an electrically conductive film on its surface facing to the developer, a measuring section measuring developer density in the container on the basis of reflected light from developer illuminated through the detection window, an electrode which is supported on the rotary member, and is rotated together with the rotary member such that a gap between the electrode and the detection window is maintained at a predetermined value, the electrode being made, at least at one portion facing to the detection window, of electrically conductive material, at least one magnet which is supported by the electrode, and which retains the developer, so that the magnet causes the developer to be brought into contact with the detection window with rotation of the rotary member, a bias application member for applying bias between the detection window and the electrode so as to make the detection window and the toner electrically repulsive to each other.

By the above described apparatus for measuring developer density, the developer retained on the magnet cleans the detection window by the developer being rubbed against the window periodically when the rotary member rotates. Further, since a gap between the detection window and the electrode is maintained at constant value, an electric effect based on the window bias becomes stable, so that adhesion of the toner onto the detection window is prevented effectively.

Consequently, the reflected light from the developer illuminated through the window corresponds to real developer density, so that it becomes possible to measure the developer density.

BRIEF DESCRIPTION OF THE DRAWINGS

These and other objects and features of the present invention will become clear from the following description taken in conjunction with the preferred embodiments thereof with reference to the accompanying drawings, in which:

FIGS. 12 and 14 show a bottom view of the sensor, and FIGS. 13 and 15 show fragmentary sectional view of the sensor shown in FIGS. 12 and 14 viewing from a direction of an arrow Z;

DETAILED DESCRIPTION OF THE INVENTION

Figure 1:
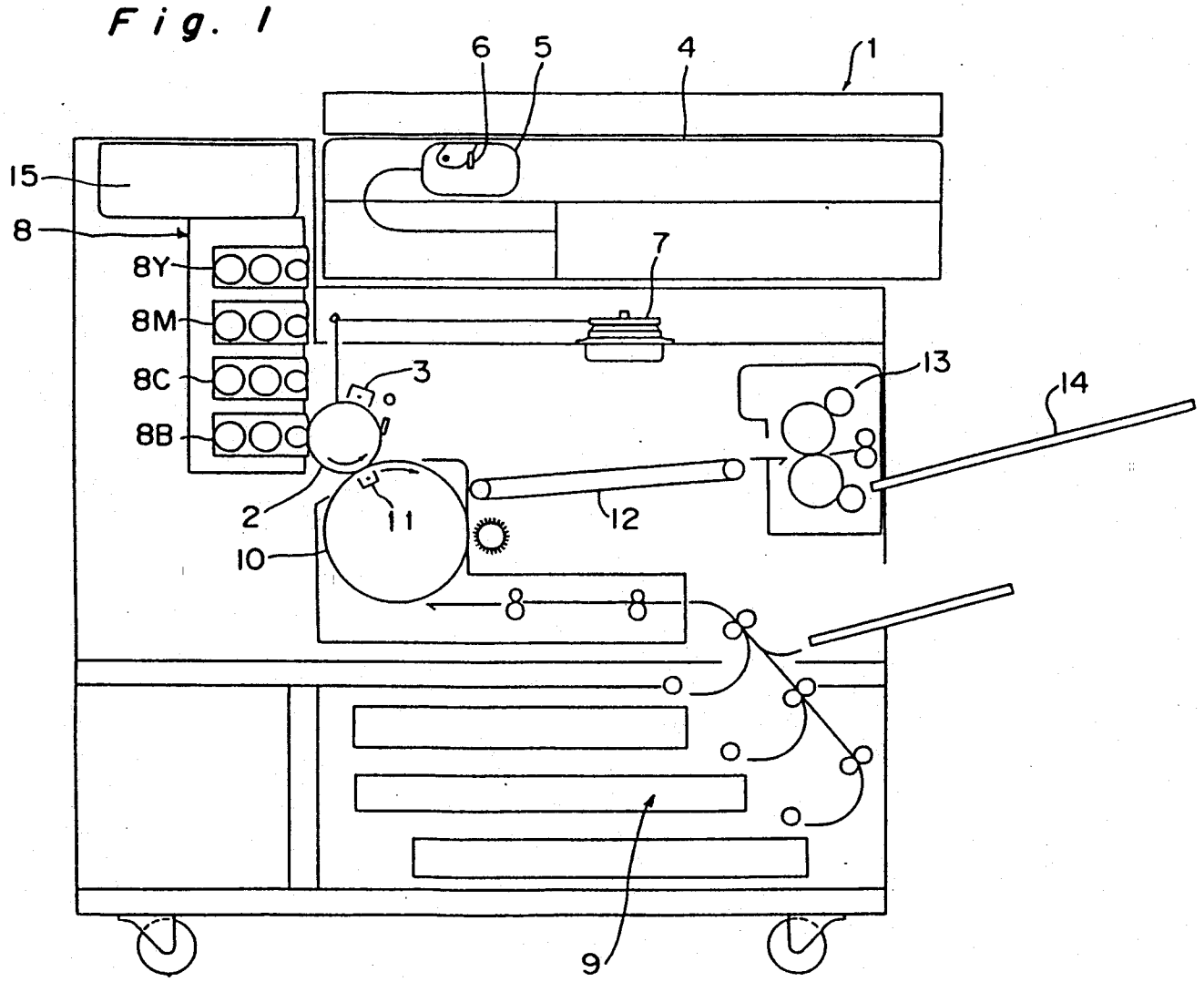
FIG. 1 is a schematic sectional view of a copying machine including an apparatus for measuring developer density, according to the present invention.

Before the description of the present invention proceeds, it is to be noted that like parts are designated by like reference numerals throughout the accompanying drawings.

I. COPYING MACHINE

Referring now to the drawings, there is shown in FIG. 1 a full-color copying machine 1 using an electrophotographic method, which includes a first embodiment of the present invention. In this copying machine 1, upon depression of printswitch (not shown), a photosensitive drum 2 rotates in the direction of an arrow, and a photosensitive layer of the photosensitive drum 2 is uniformly and electrically charged by a charging device 3.

An image reader 5 illuminates an original document (not shown) placed on an original document platform 4, and reflected light from the original document is incident on an optical reader 6 in which pixels of an image of the original document are read as color signals of red, blue and green. These color signals of red, blue and green are converted into binary image signals corresponding to each of a yellow color image, a magenta color image, a cyan color image, or, in addition to these, a black color image of the document by an image processing circuit, and each image signal is input to a laser generator 7.

The laser generator 7 illuminates the electrically charged region of the photosensitive drum 2 by a laser beam which is modulated on the basis of the image signals, and forms an electrostatic latent image there corresponding to an image information of each color.

A development unit 8 is provided with a plurality of development apparatuses 8Y, 8M, 8C, 8B. Each of these apparatuses contains a two-component developer constituted by a toner and a carrier, and moves up and down as a whole, so that a selected one of development apparatuses facing to the photosensitive drum 1 visualizes the electrostatic latent image as a toner image of a corresponding color. The above development apparatuses 8Y, 8M, 8C, 8B contain, respectively, a toner of yellow(Y), magenta(M), cyan(C) or black(B) color.

The toner image of each color is transferred successively to a transfer paper fed from a paper feeder 9, and wound around a transfer drum 10 by a transfer apparatus 11, and thus a full-color toner image is formed.

The transfer paper, on which the full-color toner image is formed, is separated from the transfer drum 10, and transported to a fixing apparatus 13 by a transportation apparatus 12, thereafter the toner image is fixed onto the transfer paper by heating, and the transfer paper is discharged into a discharge tray 14.

II. DEVELOPMENT APPARATUS

Figure 2:
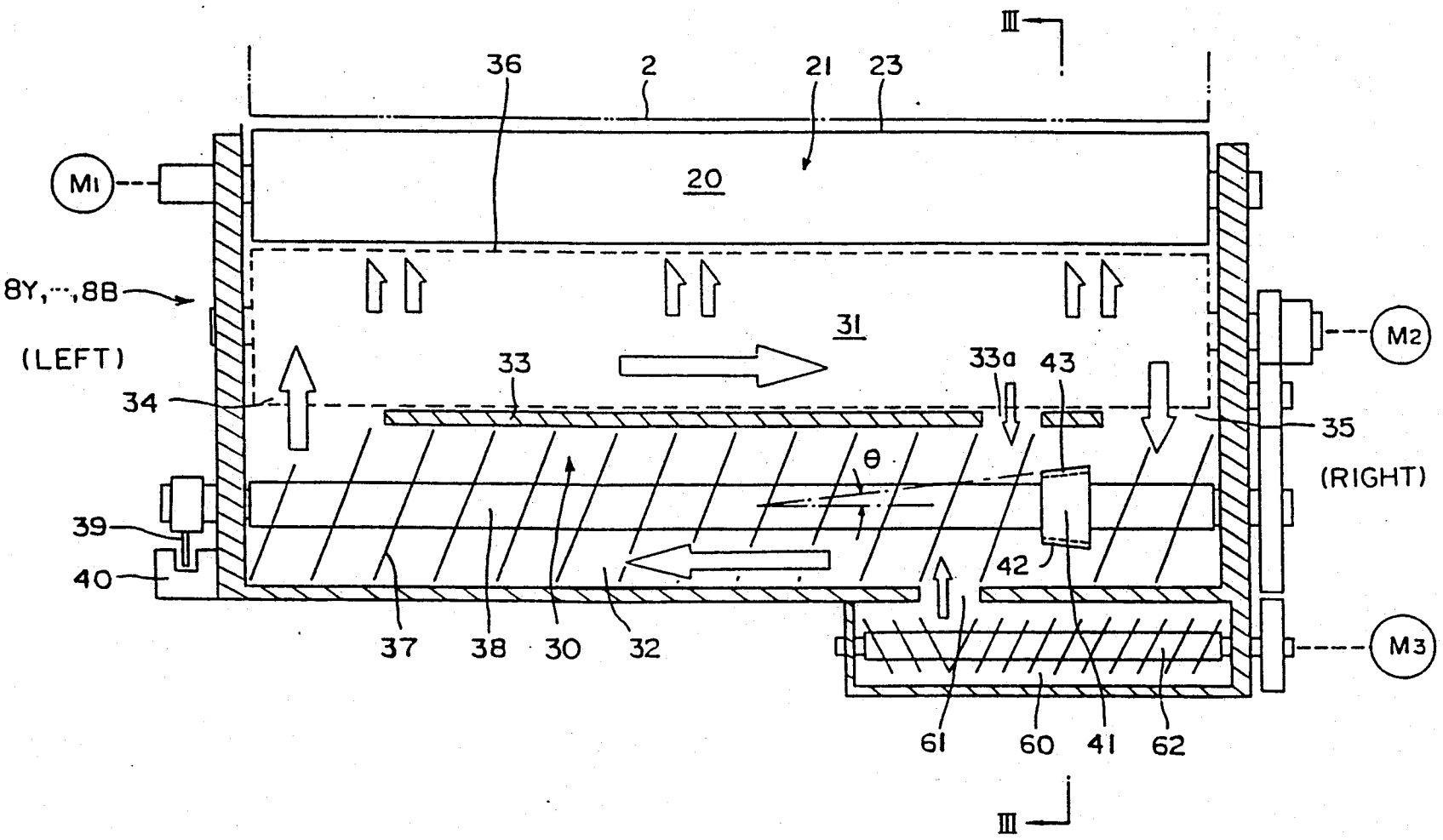
FIG. 2 is a transverse sectional view of a development apparatus showing a first embodiment of the present invention.
Figure 3:
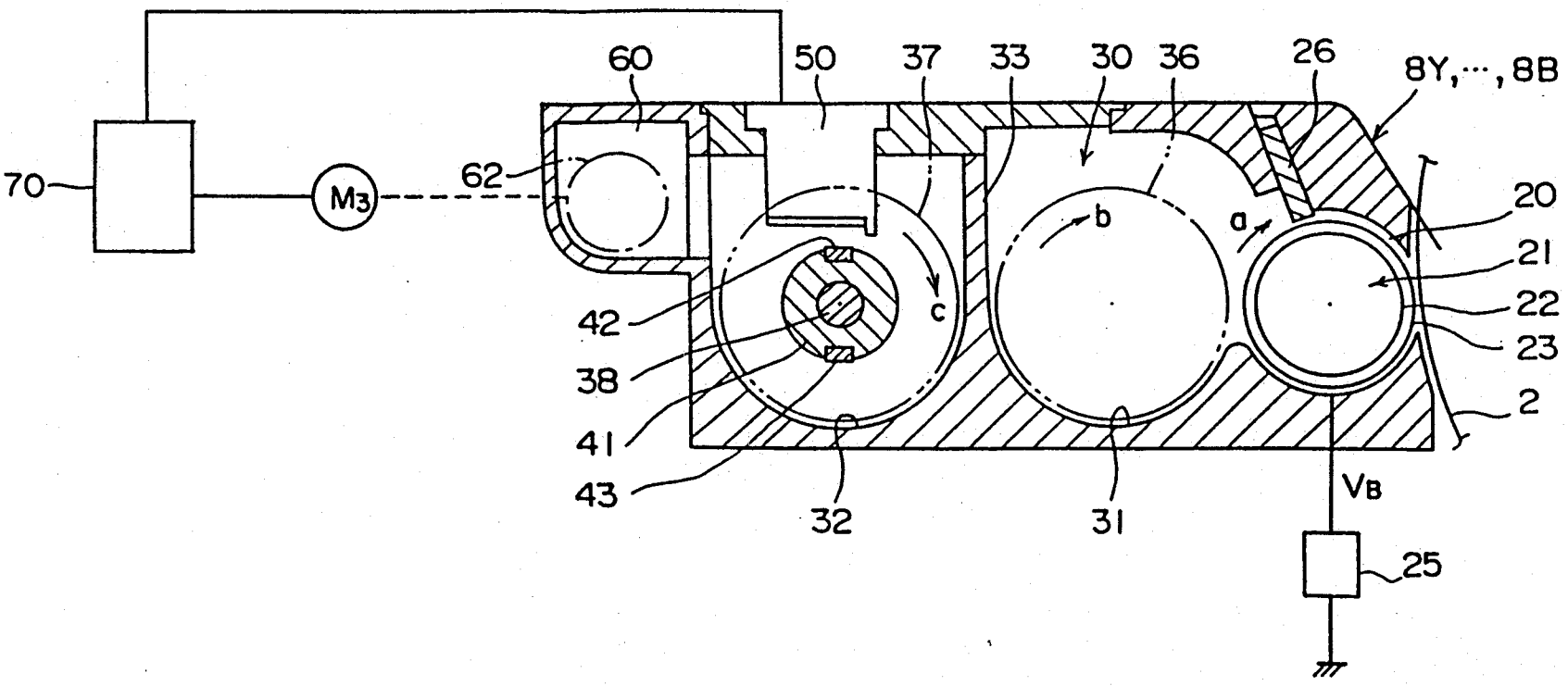
FIG. 3 is a sectional view taken along the line III—III of FIG. 2.

FIGS. 2 and 3 each show structures of the development apparatuses 8Y, 8M, 8C, 8B.

Since the development apparatuses 8Y, 8M, 8C, 8B have an identical structure, only the development apparatus 8Y is described as for common structure for the sake of brevity, hereinafter.

The development apparatus 8Y is constituted roughly by a development section 20, a developer agitator section 30(hereinafter, referred to as "agitator section 30") and a toner replenishment section 60.

(i) Development Section 20

In the development section 20, a development roller 21 situated facing to the photosensitive drum 2 is disposed. The development roller 21, which is comprised with a magnet body 22 fixed non-rotatably, and a sleeve 23, is coupled to a development motor M1 such that the sleeve 23 is driven to rotate in a direction of an arrow a. The sleeve 23 is connected with high voltage electric power source 25, so that a predetermined development bias $V_B$ is applied to the sleeve 23. Further, a blade 26 for adjusting a height of magnetic bristles is disposed so as to face to an upper peripheral surface of the sleeve 23.

(ii) Agitator Section 30

In the agitator section 30, a first agitator passage 31 and a second agitator passage 32 are formed. The first agitator passage 31 is adjacent to the development section 20, and behind it the second agitator passage 32 is situated. The first agitator passage 31 is parallel to the development section 20, while the second agitator passage 32 is inclined such that its right-hand side in FIG. 2 becomes lower than the first agitator passage 31, and its left-hand side in FIG. 2 becomes higher than the first agitator passage 31. Although these first and second agitator passages 31, 32 are separated from each other by a wall 33, they are communicated with each other by respective passages 34, 35 formed by cutting off at opposite end portions of the wall 33.

A bucket roller 36 and a conveying screw 37 are disposed in the first agitator passage 31 and the second agitator passage 31, respectively, such that both of them are coupled to an agitator motor M2, thereby they are driven so as to rotate in a direction of an arrow b, c.

A detection plate 39 is provided on a portion of a shaft 38 of the conveying screw 37 which is projected from a developer tank, and rotates together with the conveying screw 37 so as to be detected by a photo-interrupter 40. Rotated positions of magnets 42, 43 are detected by this photo-interrupter 40, as described below.

An electrode 41 is of a non-magnetic, electrically conductive material(e.g., copper, aluminum) is made in a truncated-conical and cylindrical form. Further, the electrode 41 is fitted around the shaft 38 of the conveying screw 37, so that the electrode 41 is secured in a region between the passage 35 and a bypass passage 33a, and is grounded through the shaft 38. The magnets 42, 43 are embedded at diametrically opposite positions of an outer periphery of the electrode 41. An angle $\theta$(FIGS. 2 and 4) formed between the outer peripheral surface of the electrode 41 and the shaft 38 is determined such that an uppermost peripheral surface of the electrode 41 extends horizontally when the electrode 41 is mounted on the shaft 38.

Figure 4:
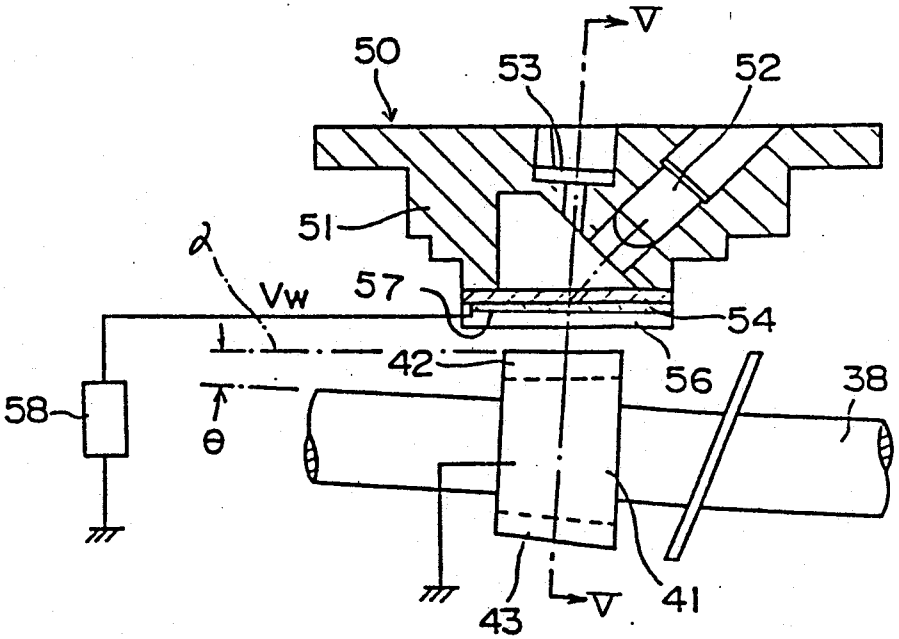
FIG. 4 is a partially cutaway side view showing the sensor for the detection of the toner density and the electrode used in the present invention.

A sensor 50 for the toner density detection, as shown in FIG. 4, is constituted by a housing 51 having an opening, a light emitting element 52 and a light receiving element 53 which are fixed to the housing 51, and a transparent detection window 54 covering detection positions of these elements 52, 53. Further, a damming wall 56 is provided along one side of the window 54. The window 54 is made of a transparent material (e.g., electrically conductive glass). On its outer surface facing to the second agitator passage 32, an electrically conductive film 57 is attached as schematically illustrated in FIG. 4.

Figure 6:
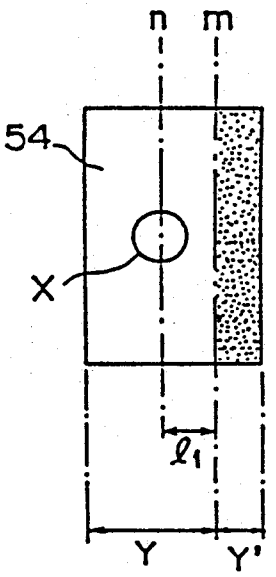
FIG. 6 is a bottom view of the detection window used in the present invention.
Figure 5:
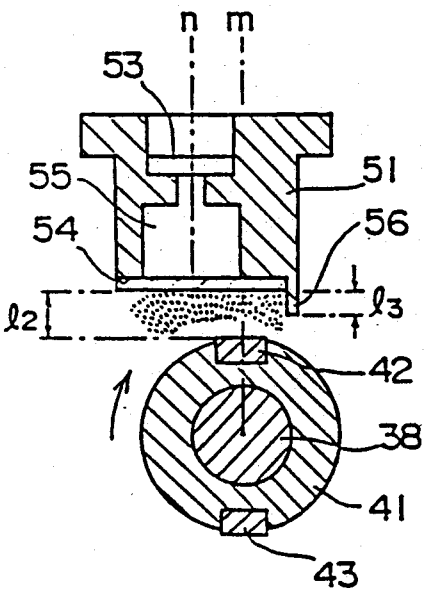
FIG. 5 is a sectional view taken along the line V—V of FIG. 4.

The sensor 50 is, as shown in FIG. 3, disposed on the upper portion of the electrode 41 such that the window 54 is situated facing to the electrode 41. Meanwhile, as shown in FIGS. 5 and 6, a detecting position X of the sensor 50 is set such that a perpendicular n extending from a center of the detecting position X is disposed upstream of a perpendicular m extending through a center of the shaft 38, in the rotational direction of the conveying screw 37. While the damming wall 56 is situated downstream of the perpendicular m in the above rotation direction. Further, the window 54 is connected with a window bias application member comprising an electric power source 58 for window bias such that the window bias $V_W$, which has same polarity as that of the charged toner, is applied to the window 54.

(iii) Toner Replenishment Section 60

The toner replenishment section 60 is adjacent to a rear portion of the second agitator passage 32, and communicates with the second agitator passage 32 through a replenishment opening 61 which is formed right-hand in FIG. 2 of the sensor 50. In addition, in the toner replenishment section 60, a replenishment screw 62 is disposed, which is coupled to a toner replenishment motor M3 such that the screw 62 is rotated by the motor M3. Further, the toner replenishment section 60 is coupled to a toner hopper 15 such that a toner of a corresponding color is replenished to the section 60 from this toner hopper 15.

III. DEVELOPMENT OPERATION OF EACH DEVELOPMENT APPARATUS (i) Development operation of each development apparatus is described hereinafter.

In the development apparatus, a developer constituted by a toner and a carrier is contained in the first agitator passage 31 and the second agitator passage 32.

The developer is conveyed along the passage shown in FIG. 2 while being mixed and agitated, with the rotations of the bucket roller 36 and the conveying screw 37. As a result, the toner and the carrier are charged to opposite polarities, respectively, such that the electrostatic latent image is developed by the developer at the portion facing the photosensitive drum 2.

In this embodiment, the toner is charged to negative polarity, and the carrier is charged to positive polarity.

Namely, the developer in the first agitator 31 is conveyed in right-ward direction in FIG. 2 with the rotation of the bucket roller 36. On the other hand, the developer is scraped by the bucket roller 36, and supplied to the sleeve 23. Further, a height of the magnetic bristles of the developer is adjusted by the blade 25, thereafter the toner in the developer is supplied to the electrostatic latent image at the portion facing to the photosensitive drum 2, thereby the electrostatic latent image is visualized.

The developer conveyed in right-ward direction in the first agitator passage 31 in FIG. 2 is conveyed into the second agitator passage 32 through the right-hand passage 35 and the bypass passage 33a. The amount of the developer conveyed through the passage 35 is substantially constant in spite of variation of the amount of the developer, while excess developer is conveyed into the second agitator passage 32 through the bypass passage 33a. Because the electrode 41 acts as flow resistance for the developer in the second agitator passage 32, and thus the amount of the developer passing through outside of the electrode 41 is regulated to be substantially constant. Therefore, the developer is uniformly dispersed without being biased from left-hand to right-hand in the first and second agitator passages 31, 32. Further, high pressure does not act on the window 54.

The developer in the second agitator passage 32 is conveyed in left-ward direction in FIG. 2 while being mixed and agitated, with the rotation of the conveying screw 37, and conveyed into the first agitator passage 31 through the left-hand passage 34.

The developer passing around the electrode 41 is retained on the magnets 42, 43 rotating with the conveying screw 37.

As shown in FIG. 5, the developer retained on the magnets 42, 43 scrapes the detection window 54 of the sensor 50 one after the other with the rotation of the conveying screw 37. Further, the developer, which is scratched off at the damming wall 56, is collected in front of the wall 56, so that the developer is brought into contact with the detection window 54 with substantially constant pressure when the magnets 42, 43 is passing through the puddle. Meanwhile, since the electrode 41 is made of non-magnetic material, the developer is collected there only when the magnets 42, 43 face the detection window 54, while, in other cases, the developer is not collected there.

When the magnets 42, 43 pass through the portion facing the wall 56, the developer, which is being conveyed in the second agitator passage 32, is replenished to the magnets 42, 43. Namely, the developer retained on the magnets 42, 43 is replaced with a new one by a constant amount in each rotation, of the magnets 42, 43 and fresh developer is conveyed to the portion facing the detection window 54. Therefore, the same developer is not repeatedly collected in front of the wall 56.

The amount of the developer collected in front of the wall 56 is closely related with a projection length $l_3$ of the wall 56, its optimum length should be determined experimentally, because in the case that the projection length $l_3$ is too long, the exchange of the developer in a lower region is not performed sufficiently, while in the case that the length $l_3$ is too short, constant contact between the detection window 54 and the developer is not attained.

Further, since the perpendicular n extending through a center of the region X of the toner density detection is situated upstream of a perpendicular m extending through a rotational center of the conveying screw 37, the developer conveyed coming into contact with the detection window 54 is compressed gradually until the developer passes through a position of the perpendicular m. By this reason, in front of the perpendicular m, contact force of the developer for the detection window 54 is strong, and thus the developer adhering onto the detection window 54 is removed efficiently in a region Y shown in FIG. 6.

On the other hand, in a region Y, between the perpendicular m and the wall 56 shown in FIG. 6, since contact force of the developer is weak, the toner adheres onto the detection window 54. However, there is no problem for the toner density detection because this region Y' is away from the position X.

Between the detection window 54 and the electrode 41, an electric field is produced by applying the window bias $V_W$, which has same polarity (i.e., negative polarity in this embodiment) as that of the charged toner, to the detection window 54 from the electric power source 58. This electric field is stable even if the conveying screw 37 rotates, because a distance 12 between the detection window 54 and the electrode 41 is maintained substantially constant.

By the electric field, the detection window 54 repulses the toner charged to same polarity as that of the window 54, adhesion of the toner onto the window 54 is prevented. However, since the carrier has a polarity opposite to the window bias $V_W$, the carrier adheres onto the detection window 54 if an effect of the electric field to the carrier is too strong. Accordingly, a value of the window bias $V_W$ should be determined experimentally in consideration for the distance $l_2$ between the window 5 and the electrode 41.

In the sensor 50 the light emitting element 52 illuminates the developer through the window 54, and reflected light from the developer is detected by the light receiving element 53.

Figure 8:
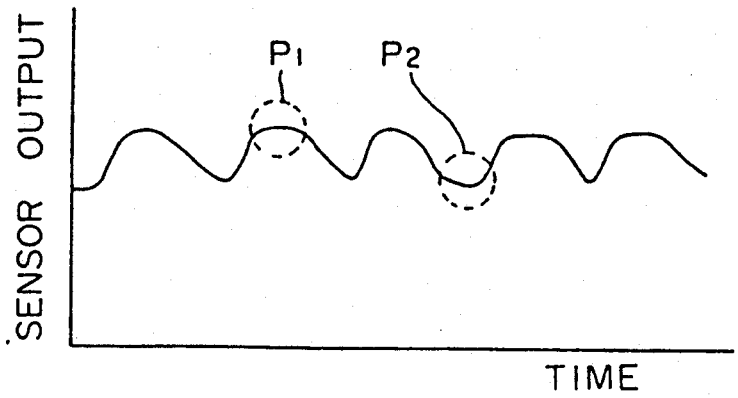
FIG. 8 shows an output of the sensor for the detection of the toner density in the present invention.

The light receiving element 53 outputs a signal of a wave form shown in FIG. 8 corresponding to quantity of the reflected light to a CPU 70.

In the output wave form shown in the FIG. 8, maximum peak portion P1 shows a signal output when the developer retained on the magnets 42, 43 is in contact with the detection window 54, and the toner density is measured by sampling the signals in this region. Meanwhile, minimum peak portion P2 shows a signal output when the magnets 42, 43 are away from the detection window 54.

Figure 9:
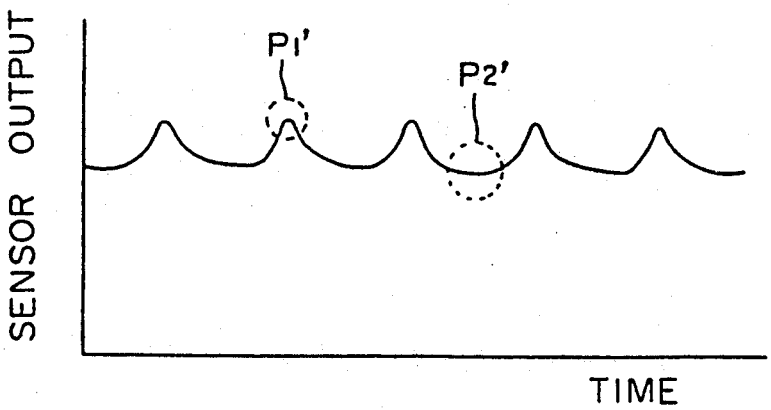
FIG. 9 shows an output of a sensor of a development apparatus provided with no damming wall.

For comparison, an output from a sensor in the case that the damming wall 56 is not provided is shown in FIG. 9. In this FIG. 9, maximum peak P1' shows a signal in the case that the magnets 42, 43 face to the detection window 54, minimum peak P2' shows a signal in the case that the magnets 42, 43 are away from the detection window 54.

As shown in FIGS. 8 and 9, it can be understood that the developer retained on the magnets 42, 43 stays a relatively long time at the detection position X of the detection window 54, and the signal shown by the maximum peak portion P1 is stabilized by providing the damming wall 56 as shown in this embodiment.

In the CPU 70, on the basis of the output from the sensor 50, the toner density is judged as follows.

Namely, on the basis of timing at which the plate 39 mounted on the conveying screw 37 is detected by the photo-interrupter 40, data of the maximum peak portion P1 are sampled, so that the toner density is measured on the basis of the sampled data. Meanwhile, as described above, since the output of the maximum peak portion P1 is stable, variation of the sampled data is little, therefore reliability of the measured toner density is high.

As a result of the measurement, if the toner density is judged that it is less than a predetermined reference density, the toner is replenished to the toner replenishment section 60 from the toner hopper 15 which contains a toner of a corresponding color. The replenished toner is conveyed into the second agitator passage 32 through the toner replenishment opening 61, with the rotation of the motor M3.

Hereinafter, descriptions are made about experiments performed with respect to optimum window bias $V_W$ applied to the detection window 54.

In these experiments, the distance between the perpendicular m and the perpendicular n is set to 4 mm, the magnetic force of the magnets 42, 43 is set to 2,000 gauss.

Figure 7:
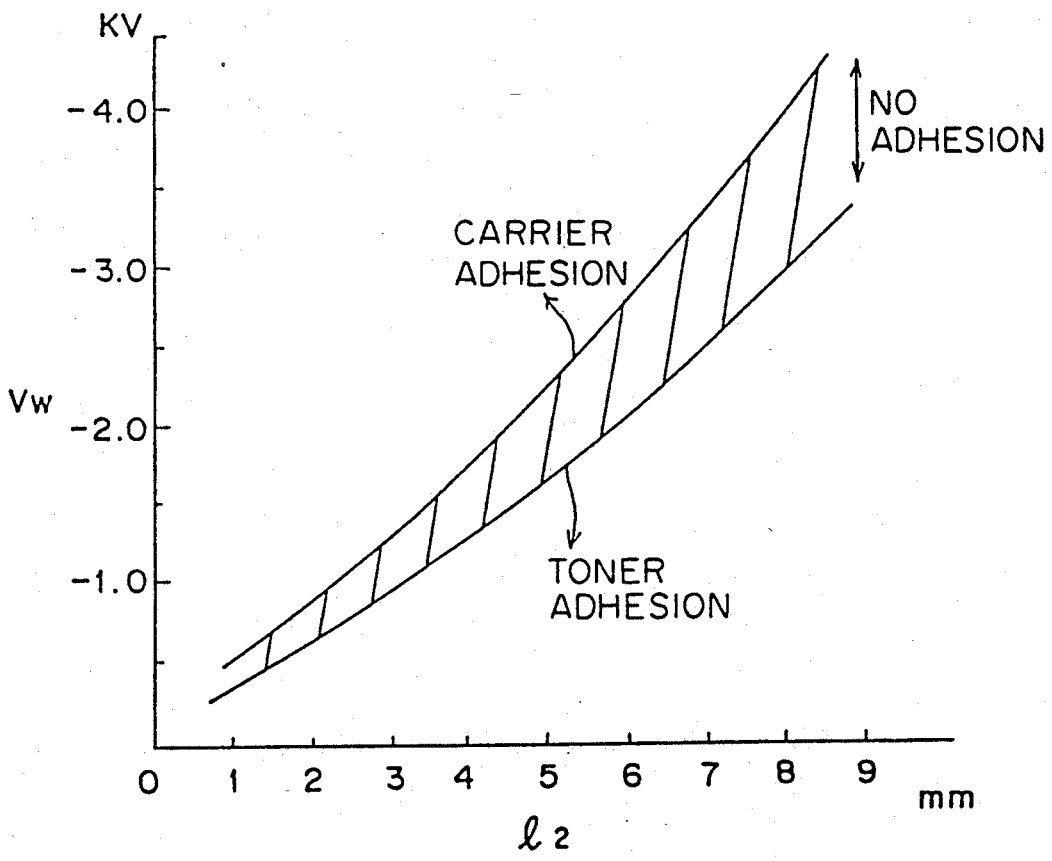
FIG. 7 shows a relation between the distance between the detection window and the electrode and optimum window bias $V_W$ used in the present invention.

As a result of the experiments, as shown in FIG. 7, in the case that the distance $l_2$ between the detection window 54 and the electrode 41 is constant, the carrier adheres onto the detection window 54 when the window bias $V_W$ is too high, while a toner adheres onto the detection window 54 when the window bias $V_W$ is too low.

Further, in the case that the distance $l_2$ is narrow, the developer is jammed between the detection window 54 and the electrode 41, or alternation of the developer became inactive, while in the case that the distance $l_2$ is wide and the window bias $V_W$ is high, it became necessary to insulate the corresponding portions securely.

Therefore, a value of the window bias $V_W$ should be determined to be optimum experimentally, considering the above described phenomena.

In the above description, although the whole of the cylindrical electrode 41 is made of electrically conductive material, it may also be that cylindrical member is made of insulation, and a surface of it is covered by an electrically conductive material.

As will be apparent from the description given so far, in the apparatus for measuring developer density of the invention, the electrode is provided on the rotational member in the developer agitator section such that constant distance is maintained between this section and the detection window, and the window bias is applied between the detection window and the electrode such that the detection window and the toner are repulsive electrically to each other, and magnets are provided on the electrode so as to clean the detection window by the developer retained on the magnets.

Accordingly, adhesion onto the detection window is prevented by the electric field produced by the window bias. Further, since the distance between the detection window and the electrode is fixed, its field-effect is exercised stably. Further, the developer adhering onto the detection window is removed by the developer retained by the magnets. Namely, the detection window is maintained so as to be prevented from adhesion of the developer by the electric field-effect and the cleaning operation of the developer retained by the magnets.

As a result, the reflected light from the developer illuminated through the detection window corresponds to real developer density, so that it becomes possible to measure the developer density with high accuracy.

Figure 10:
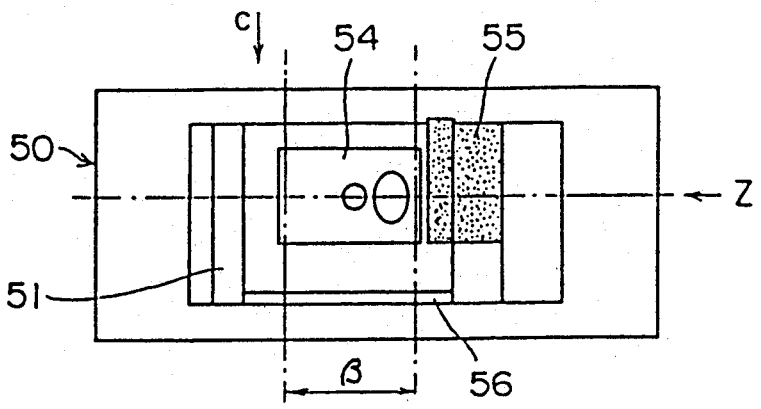
FIG. 10 shows a bottom view of the sensor for detecting a toner density of the second embodiment of the present invention.
Figure 11:
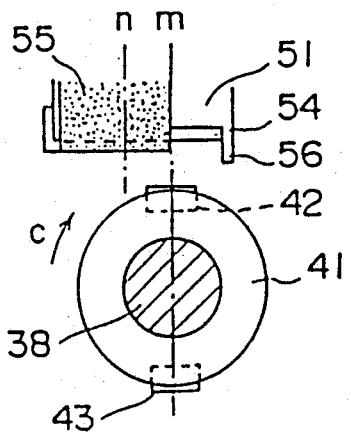
FIG. 11 shows a partially sectioned view of the sensor shown in FIG. 10 viewing from a direction of an arrow Z.
Figure 12:
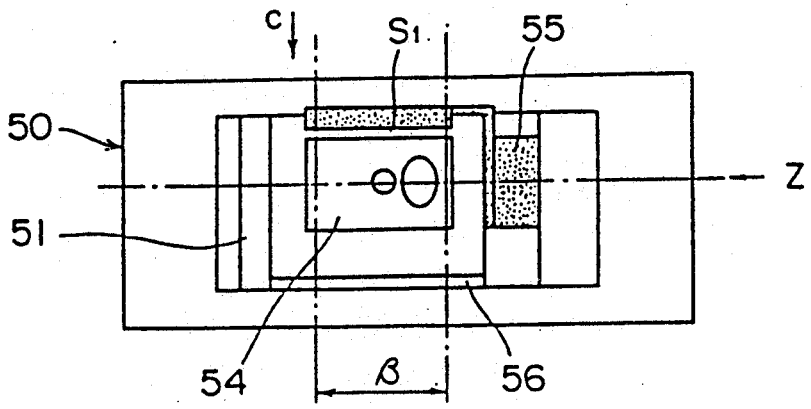
FIGS. 12 to 15 show example with respect to arrangements of electrode members for comparison.
Figure 13:
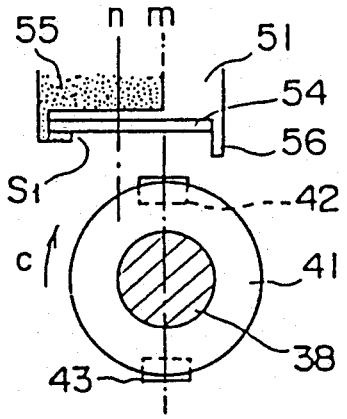
Figure 14:
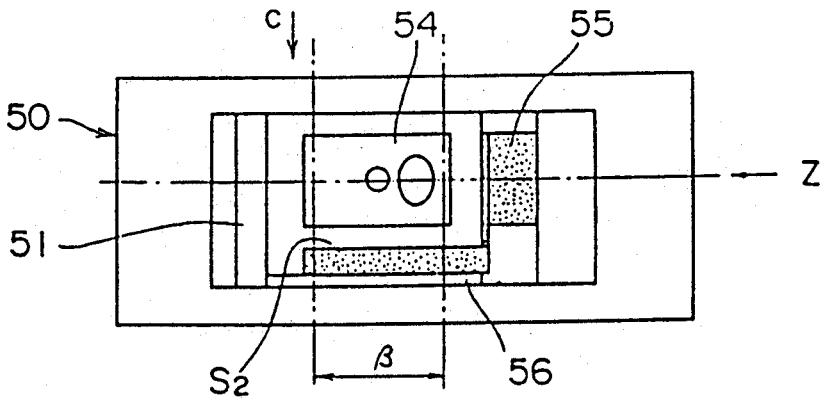
Figure 15:
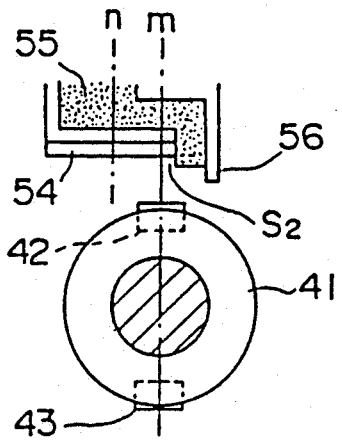

As shown in FIG. 10, in a second embodiment of the present invention, the detection window 54 is provided such that an electrode member 55 is situated at the outside of a region $\beta$ which includes widths in axial direction of the electrode 41 and magnets 42, 43.

Further, the electrode member 55 is connected with the electric power source 58 for the window bias such that the window bias $V_2$, which has same polarity as that of the charged toner, is applied to the detection window 54 through the electrode member 55.

In this manner, since the electrode member 55 is disposed at the outside of the region $\beta$ in which magnets 42, 43 move, namely it is provided in a region in which it does not interfere with the developer retained on the magnets 42, 43, the developer conveyed in the direction of an arrow c does not come into contact with the electrode member 55, and this developer does not stay in a stair portion between the electrode member 55 and the detection window 54. Consequently, the detection window 54 is maintained in a condition of no adhesion onto the toner.

Referring now to FIGS. 12 and 13, and FIGS. 14 and 15 which show examples for comparison, in an apparatus in which the electrode member 55 is disposed at the inside of the region $\beta$ in which the electrode member 55 interferes with the developer, the developer conveyed in the direction of an arrow c stays in a stair portion S1(See FIG. 12), S2(See FIG. 14), and the detection window 54 is contaminated, and thus it becomes difficult to measure toner density. Especially, in the cases of FIGS. 14 and 15, there is a drawback in that the developer conveyed in the direction of an arrow c is pressed into a portion between the electrode member 55 and the detection window 54, thereby an electrical connection between them is interrupted.

Since other constructions and operations of the apparatus of this second embodiment are same as those of the apparatus of the afore-mentioned embodiment, description thereof is abbreviated for the sake of brevity.

As will be apparent from the description given so far, in the apparatus for measuring a developer density of the invention, an electrically conductive film is formed on the surface of the detection window so as to apply the window bias having a polarity identical with that of the charged toner to the film. Further, the electrode member, which connects electrically the film with the electric power source, is disposed in the region where the electrode member does not interfere with the developer.

Accordingly, the detection window repulses electrically the toner, and thus the adhesion of the toner onto the window is prevented.

Further, the developer does not stay in the stair portion between the electrode member and the detection window, and thus the developer is not an impediment to electrical connection between the electrode and the detection window.

As a result, the reflected light from the developer illuminated through the detection window corresponds to real developer density, and thus it becomes possible to measure the developer density with high accuracy.

As shown in FIGS. 16 to 19, in a third embodiment of the invention, a development roll 21 is supported at its both ends by side walls 81(81*a*), 81(81*b*), and a gear G1 is mounted around a shaft 21*a*, which projects from the side wall 81*b*, for driving the sleeve 23.

Figure 20:
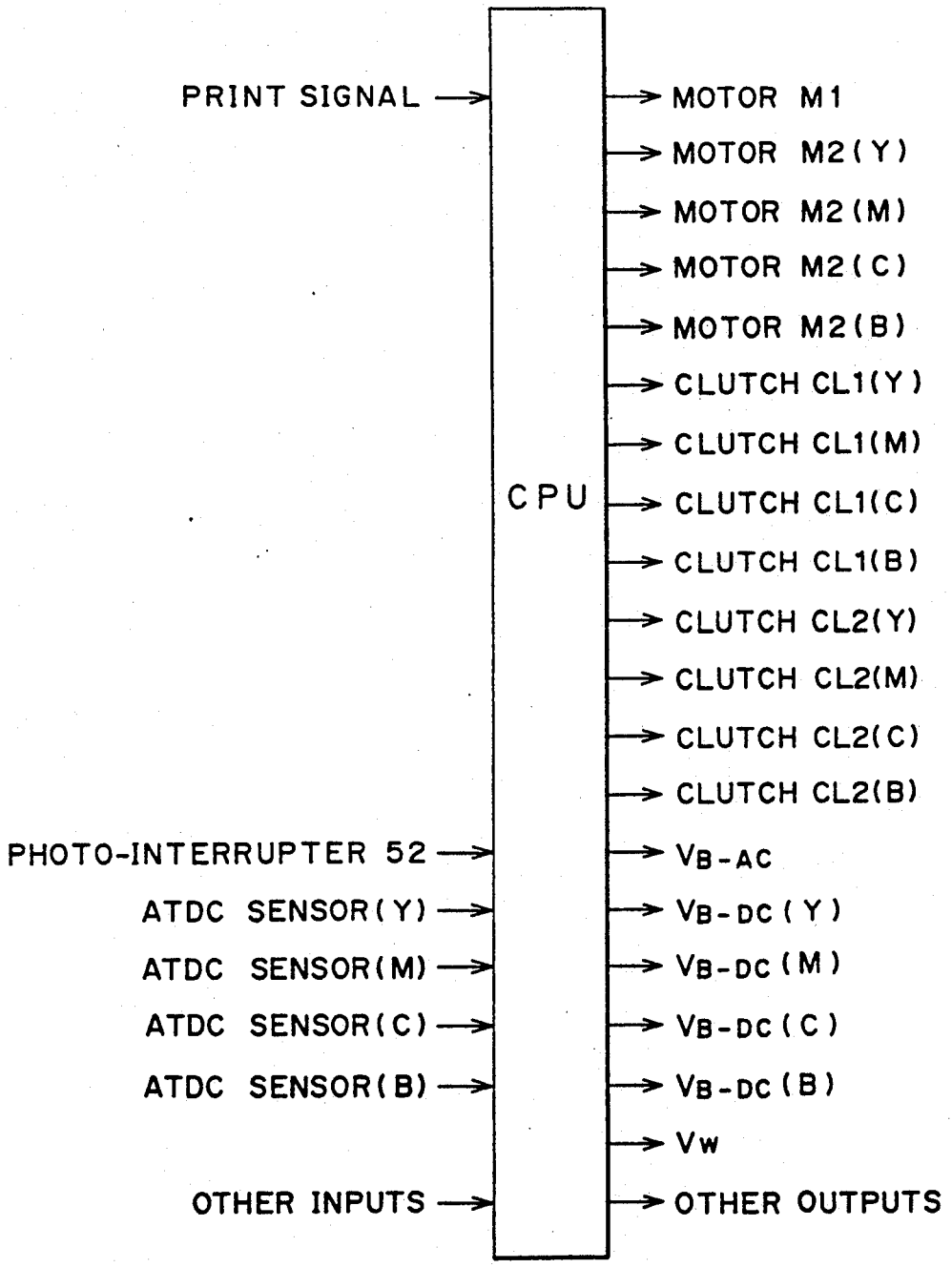
FIG. 20 shows inputs and outputs in a CPU used in the third embodiment of the present invention.

In addition, the sleeve 23 is connected with an electric power source 25*a* for the development bias having a DC electric power source 27 and an AC electric power source 28 such that development bias $V_B$, which is a sum of DC development bias $V_{B\text{-}DC}$ and development bias $V_{B\text{-}DC}(V_B=V_{B\text{-}DC}+V_{B\text{-}AC})$, is applied to the sleeve 23, and an output from the DC electric power source 27 is changed over in response to a signal from the CPU (See FIG. 20). Meanwhile, the DC development bias $V_{B\text{-}DC}$ has different values at the development apparatuses 8Y, 8M, 8C, 8B, respectively, while the AC development bias $V_{B\text{-}AC}$ has an identical value at the development apparatus 8Y, 8M, 8C, 8B.

In a developer agitator section 30, the developer apparatuses 8Y, 8M, 8C, 8B are disposed in a copying machine such that the first agitator passage 31 extends horizontally.

Further, the bucket roller 36 is disposed in the first agitator passage 31 such that it is supported rotatably by the side walls 81, 81 of the housing. In addition, a gear G2a is mounted around a shaft 36*a* of the bucket roller 36 projecting from the side wall 81*a*, and the gear G2a is coupled to a motor M1 a through clutch CL1, so that the gear G2a is driven. Meanwhile, the motor is disposed in a main body of the copying machine such that the motor M1 drives a development apparatus facing the photosensitive drum 2. On the other hand, the clutch CL1 is provided in each development apparatus, and thus each development apparatus can be coupled to the motor M1 through each clutch CL1, so as to be driven independently.

A gear G2b is mounted around the shaft 36*a* of the bucket roller 36 which is projected from the side wall 81*b*. This gear G2b is coupled to a gear G1 for driving the sleeve 23 through gear G3. In addition, a transmittance of driving force for the gear G1 can be intercepted by a clutch CL2.

Accordingly, a rotation of the motor M1 is transmitted to the bucket roller 36 by the clutch being connected. Further, under this condition, driving force of the motor M1 is transmitted to the sleeve 24 by the clutch being connected.

The conveying screw 37 is disposed in the second agitator passage 32 such that side walls 81, 81 of the housing are supported rotatably. The electrode 41, which is made of electrically conductive non-magnetic material as in the shaft 38, is provided on the shaft 38 of the conveying screw 37 in a region between the right-hand passage 35 in FIG. 16 and the bypass passage 34.

This electrode 41 is made in a form of a truncated cone, and magnets 44, 44 are embedded at diametrically opposite positions of an outer periphery of the electrode 41 such that an uppermost peripheral surface of the magnets extend horizontally. Namely, an inclination angle $\theta$ of the conveying screw 37 is cancelled by a slope of an outer surface of the electrode 41, and thus the uppermost surface of the electrode 41 extends in parallel with a horizontal line $\alpha$.

Around one end of the shaft 38 of the conveying screw 37 projecting from the side wall 81*a* of the housing, a gear G4 is mounted. This gear G4 is coupled to a gear G2a mounted around a shaft 36*a* of the bucket roller 36 through other gear G5. Accordingly, the conveying screw 37 rotates synchronously with the bucket roller 36.

Figure 19:
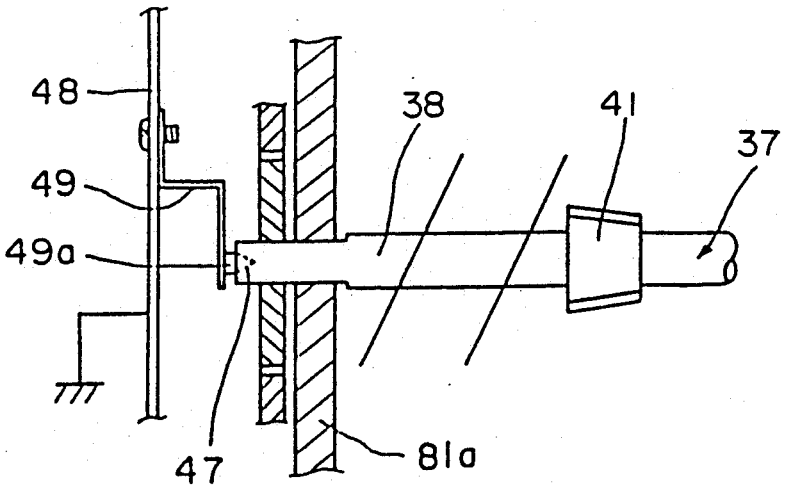
FIG. 19 shows a transverse sectional view showing an aspect of a grounded electrode in the apparatus according to the third embodiment of the present invention.

Further, as shown in FIG. 19, at one end of a shaft 38 of the conveying screw 37, a recess portion 47 is formed. On the other hand, a leaf spring 49 is disposed in a gear box 48, and a terminal 49*a*, which is provided on the leaf spring 49, is fitted into the recess portion 47, and thus the electrode 41 and the shaft 38 are grounded.

Further, on the other end of the shaft 38 of the conveying screw 37 projecting from the side wall 81*b* of the housing, a detection plate 39 having a photo-interrupter 40 for detecting the detection plate 39 at its side portion is attached. Meanwhile, the detection plate 39, magnets 44, 44 and the photo-interrupter 40 are situated in specified relation such that positions of the magnets 44, 44 can be confirmed by a detection signal from the photo-interrupter 40.

In order to prevent adherence of the toner to the lower face of the detection window 54, the detection window 58 is charged to a polarity identical with that of the toner by two methods. Namely, in one method the lower face of the detection window 54 is coated with an electrically conductive film and bias having a polarity identical with that of the toner is applied to the lower face of the detection window 54. Meanwhile, in the other method, the lower face of the detection window 54 is made of material which is charged, through its contact with the developer, to a polarity identical with that of the toner in tribo-electric charging series.

Figure 18:
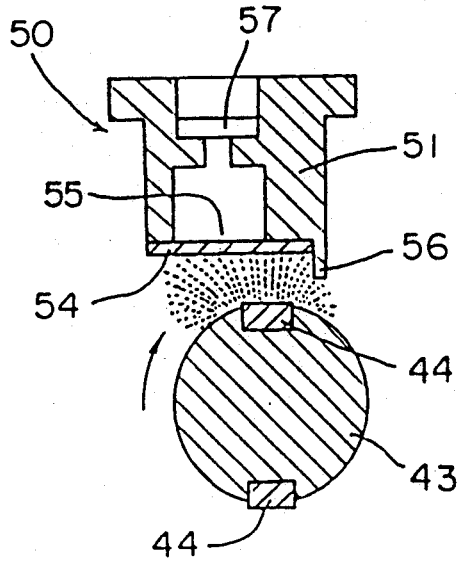
FIG. 18 shows a sectional view of a sensor shown in FIG. 16 similar to FIG. 5.

As shown in FIG. 18, a sensor 50 for measuring toner density is disposed above the electrode 41 such that the detection window 54 faces the electrode 41. The damming wall 56 is disposed at one side of the housing 51 adjacent to the photosensitive drum 2. The film of the detection window 54 is connected with the electric power source 70 so as to apply the DC window bias $V_W$ to the film. Meanwhile, in the case that the detection window 54 is made of the material which is charged to a polarity identical with that of the charged toner by being brought into contact with the developer, it is not necessary to apply the window bias.

A replenishment screw 62 is disposed in a toner replenishment section 60. Around one end of a shaft of the replenishment screw 62 projecting from the side wall 81a of the housing, a gear G6 is mounted so as to engage with a gear G4 secured around the shaft 38 of the conveying screw 37. Accordingly, the replenishment screw 62 rotates with the conveying screw 37 and the bucket roller 36 synchronously. In addition, the toner replenishment section 60 is connected with the toner storage hopper 15(See FIG. 1) such that each toner is replenished to the toner replenishment section 60 of each development apparatus corresponding to transmission of driving force of each motor M2.

As shown in FIG. 20, a CPU outputs remote signals to the development motor M1, each toner replenishment motor M2(Y, M, C, B), each clutch CLl(Y, M, C, B), each clutch CL2(Y, M, C, B), respectively, output signals for the AC development bias $V_{B\text{-}AC}$ and the DC development bias $V_{B\text{-}DC}$ to each electric power source 25*a*(Y, M, C, B), and output signal for the window bias $V_W$ to the electric power source 70. Furthermore, the CPU receives a print signal, and receives signals from each photo-interrupter 40(Y, M, C, B), and each sensor 50(hereinafter, referred to as "ATDC sensor 50")(Y, M, C, B).

A. Development Operation

Development operation of the development apparatus facing the photosensitive drum 2 is described hereinafter.

The developer is contained in the first agitator passage 31, and the second agitator passage 32. Meanwhile, the toner and the carrier used in this embodiment are charged to opposite polarity from each other, namely, the toner is charged to negative polarity, while the carrier is charged to positive polarity by being brought into contact mutually.

By driving the motor M1, and connecting the clutches CL1, CL2, driving force of the motor M1 is transmitted to the sleeve 23, the bucket roller 37, the conveying screw and the replenishment screw 62, and thus they are rotated in the direction of arrows a, b, c, d.

Figure 16:
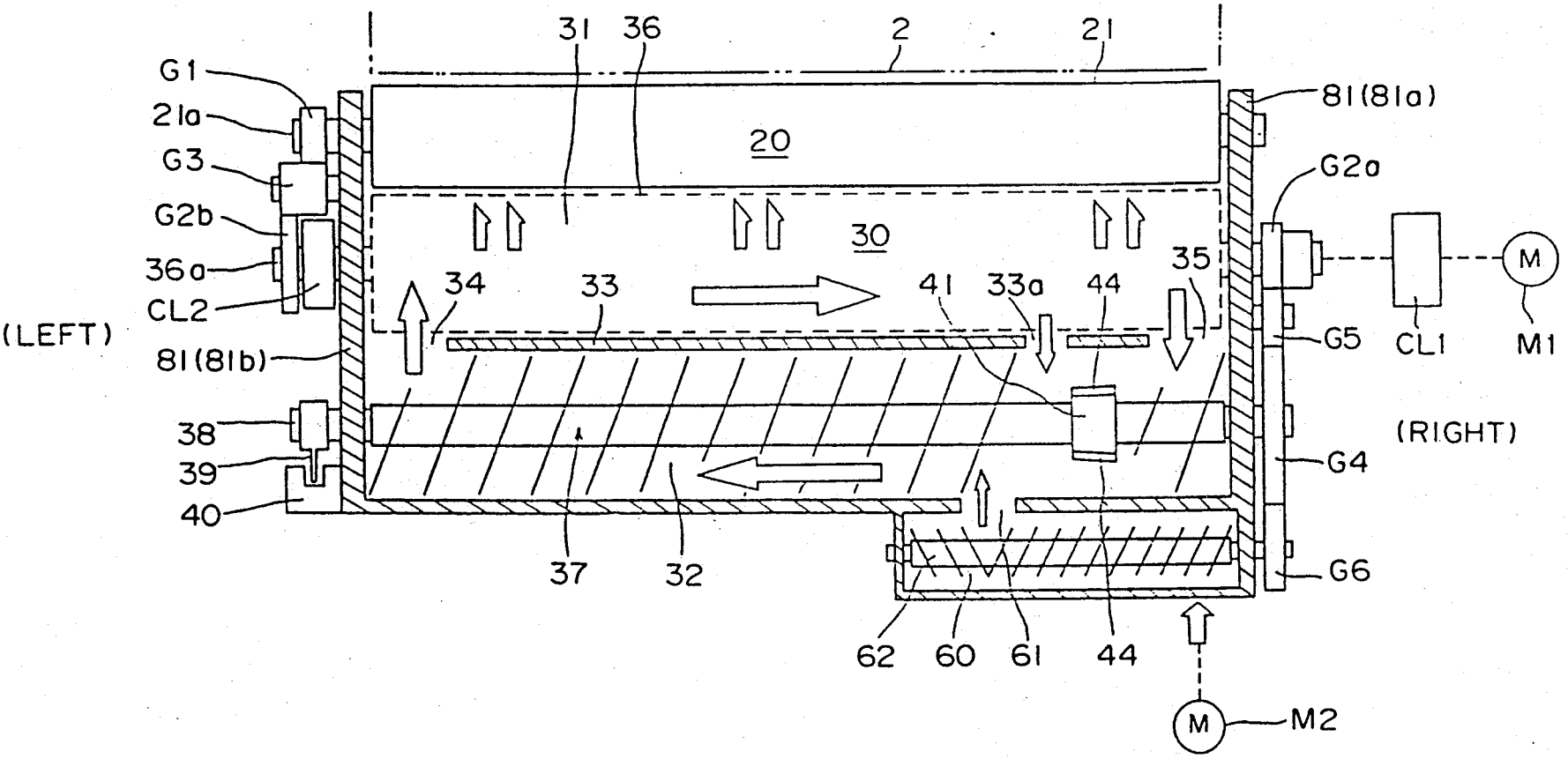
FIG. 16 show a transverse sectional view of development apparatus according to third embodiment of the present invention.
Figure 17:
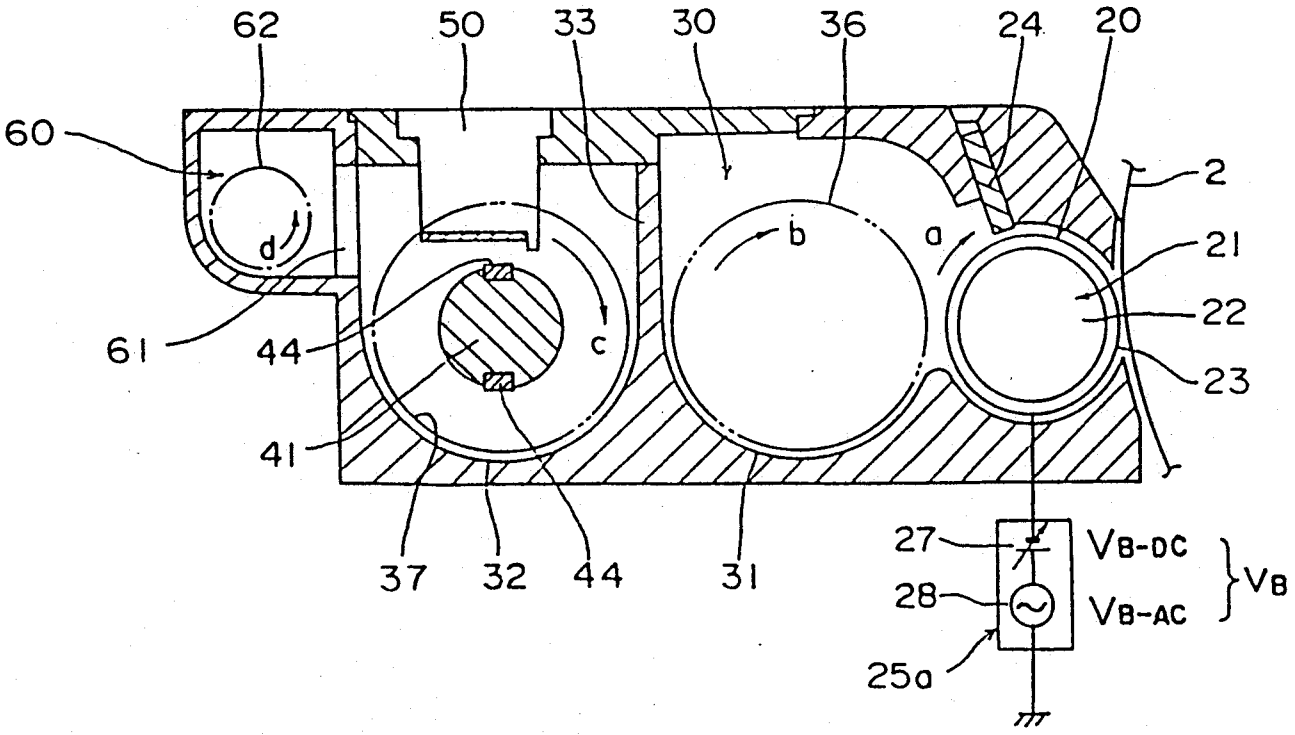
FIG. 17 shows a longitudinal sectional view of the apparatus shown in FIG. 16.

Thereby, the developer is mixed and conveyed through its circulation in the first agitator passage 31 and the second agitator passage 32 in the direction of an arrow (in clockwise direction) shown in FIG. 16 with rotations of the bucket roller 36, and the conveying screw 37. Thus, the toner and the carrier are charged to opposite polarity from each other by being brought into contact mutually.

Namely, the developer in the first agitator passage 31 is conveyed in the right-ward direction in FIG. 16. During the conveyance of the developer, the developer is supplied to the sleeve 23.

The developer supplied to the sleeve 23 is retained on the outer peripheral surface of the sleeve 23 in a state of magnetic brush by magnetic force of the magnet body 22, and it passes through a portion facing the blade 24 with a rotation of the sleeve 23, thereafter it supplies the toner to an electrostatic latent image at a portion facing the photosensitive drum 2.

Meanwhile, the supplement of the toner to the photosensitive drum 2 is performed corresponding to electric potential difference between electric potential of a surface of the photosensitive drum 2 and the DC development bias $V_{B\text{-}DC}$ of the development bias $V_B$.

The developer conveyed to the first agitator passage 31 is carried into the second agitator passage 32 through the passage 35, and the bypass passage 33*a*.

The amount of the developer conveyed into the first agitator passage 31 through the passage 34 is stable, other developer in the second agitator passage 32 is carried into the first agitator passage 31 through the bypass passage 33*a*, because the conveyance of the developer is interrupted in the second agitator passage 32 by the electrode 41, and thus the developer passing through a region around the electrode 41 is restricted to a substantially constant amount.

The developer in the second agitator passage 32 is conveyed in the left-ward direction in FIG. 16 and mixed through its circulation with the rotation of the conveying screw 37 and carried to the first agitator passage 31 through the passage 34.

The developer passing through the region around the electrode 41 is retained succeedingly on the magnets 44, 44 rotating with the conveying screw 37.

As shown in FIG. 18, the developer retained on the magnets 44, 44 forms a magnetic brush, and it is rubbed against the detection window 54 with the rotation of the conveying screw 37. A part of the developer passing through a region facing to the detection window 54 is dammed by the damming wall 56, so that the developer is collected in front of the detection window 54. Thus, the developer is brought into contact with the detection window 54, at substantially constant pressure, and stably when the magnets 44, 44 are passing through the region facing to the window.

Figure 21:
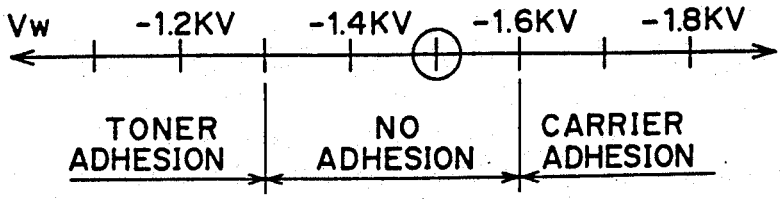
FIG. 21 shows a relation between a window bias and adhesion of a toner or a carrier onto the detection window in the third embodiment of the present invention.

In this embodiment, the window bias $V_W$ is set to $-1.5$ KV. This window bias $V_W$ is determined experimentally such that the adhesion of the toner and the carrier onto the detection window 54 is prevented. Namely, as shown in FIG. 21, in the development apparatus 8Y, 8M, 8C, 8B, the toner adheres onto the detection window 54 when the window bias $V_W$ is lower than $-1.3$ KV, while the carrier adheres onto the detection window 54 when the window bias $V_W$ is higher than $-1.6$ KV. Therefore, in this embodiment, the window bias $V_W$ is set to the value between $-1.3$ KV and $-1.6$ KV so as to prevent the adhesion of the toner and the carrier.

In the sensor 50, reflected light from the developer, which is illuminated through the detection window 54 by the light emitting element 52, is detected by the light receiving element 53.

The light receiving element 53 outputs a signal of voltage corresponding to the quantity of the reflected light to the CPU.

The CPU controls the motor M2 corresponding to the measured toner density.

Figure 22:
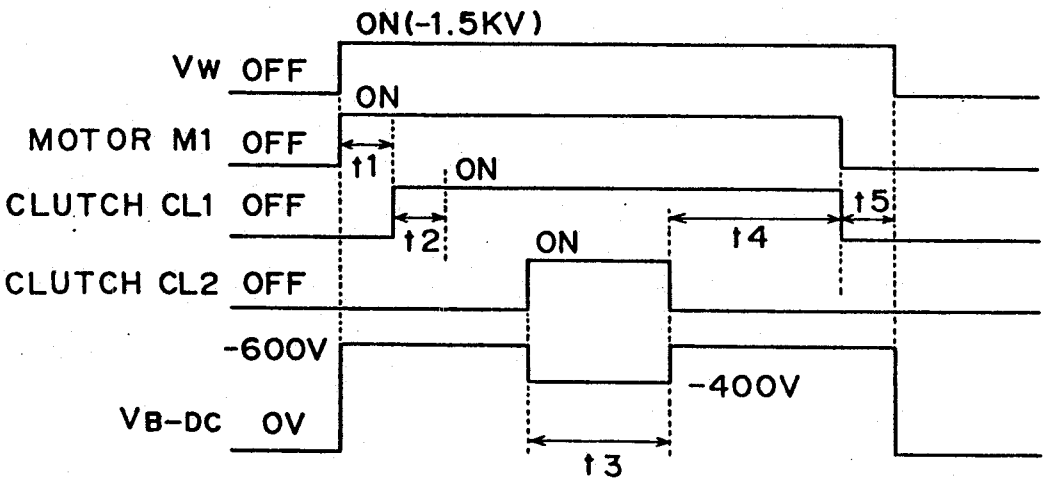
FIG. 22 shows a time chart regarding to control for the development bias in the third embodiment of the present invention.
Figure 24:
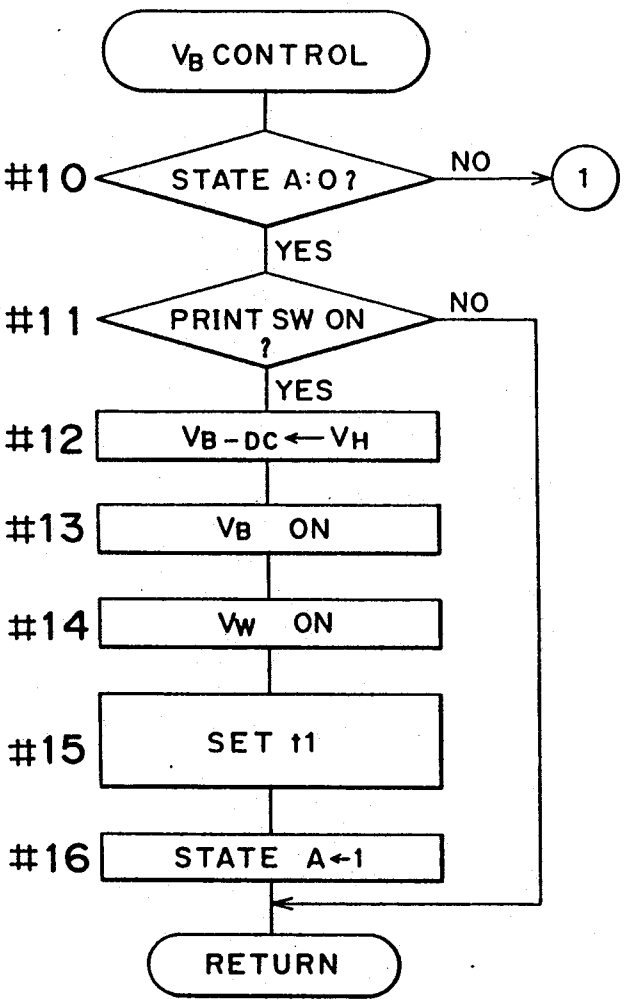
FIGS. 24 to 30 show flow charts regarding the control for the development bias in the third embodiment of the present invention.
Figure 25:
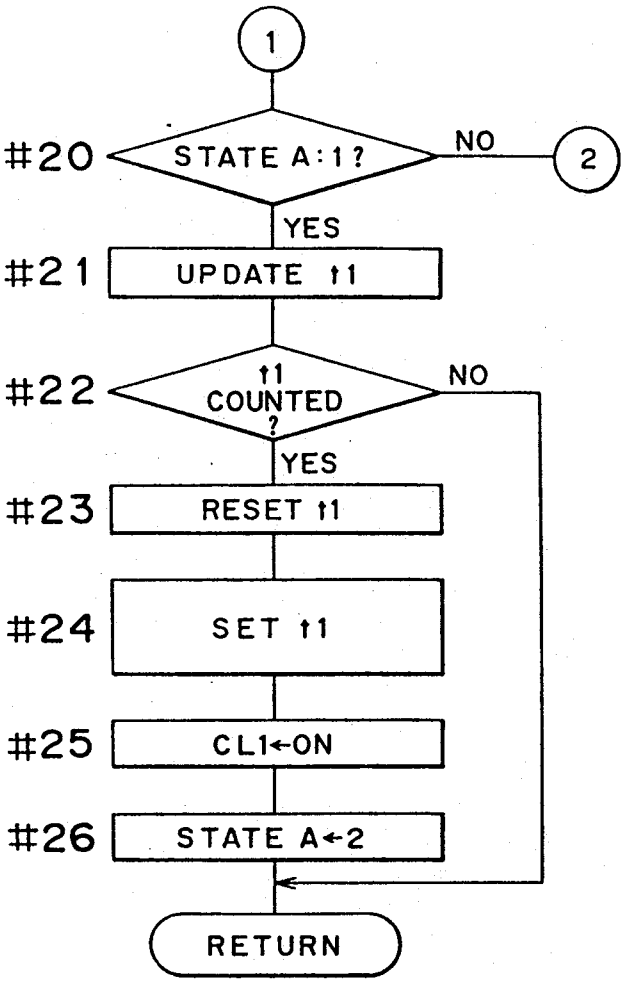
Figure 27:
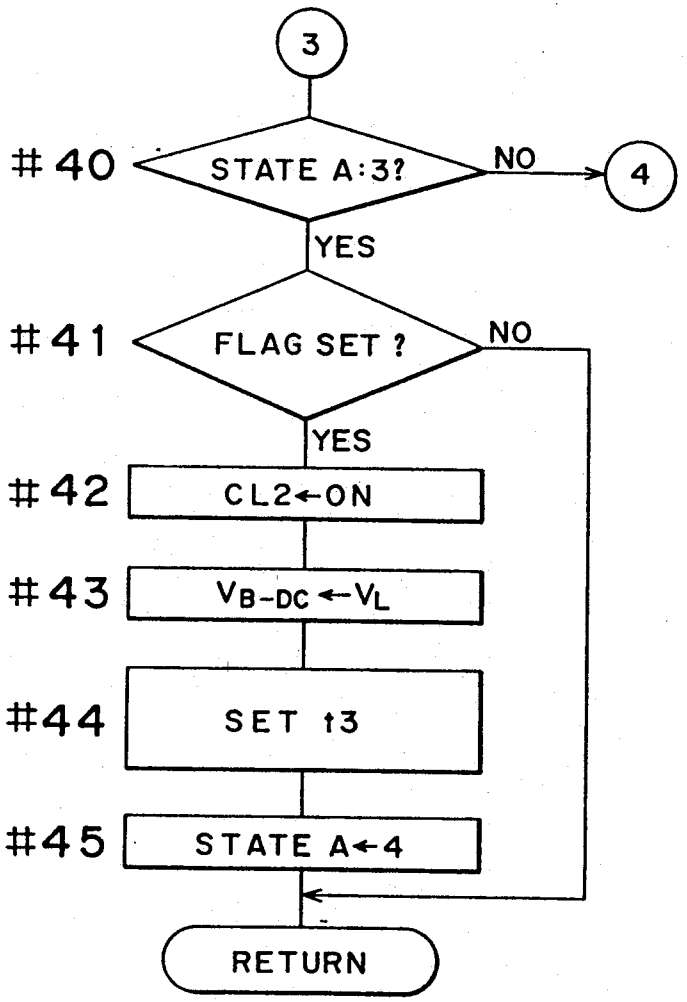
Figure 26:
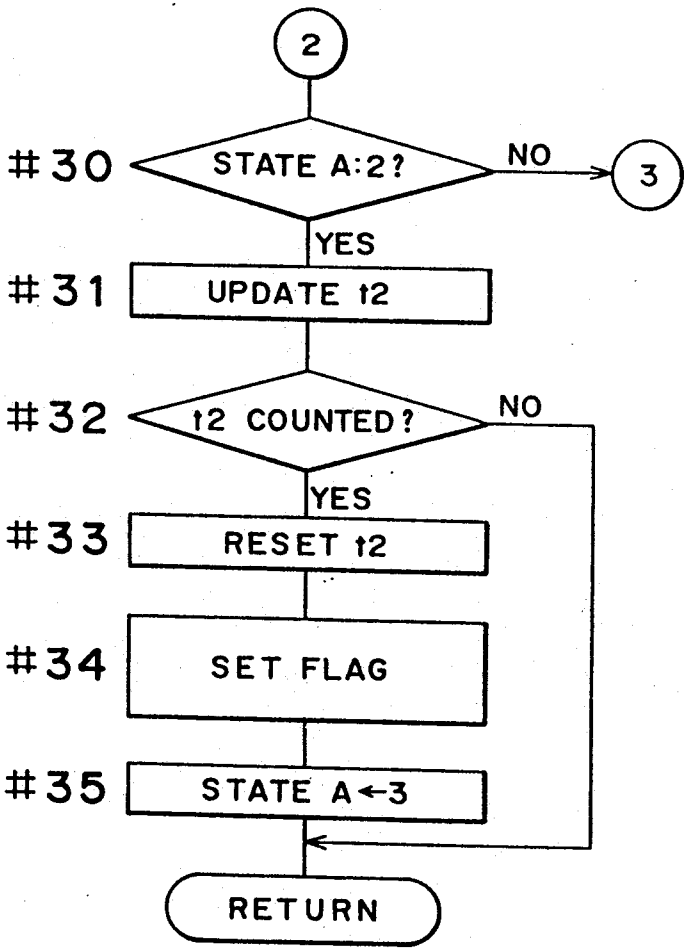
Figure 29:
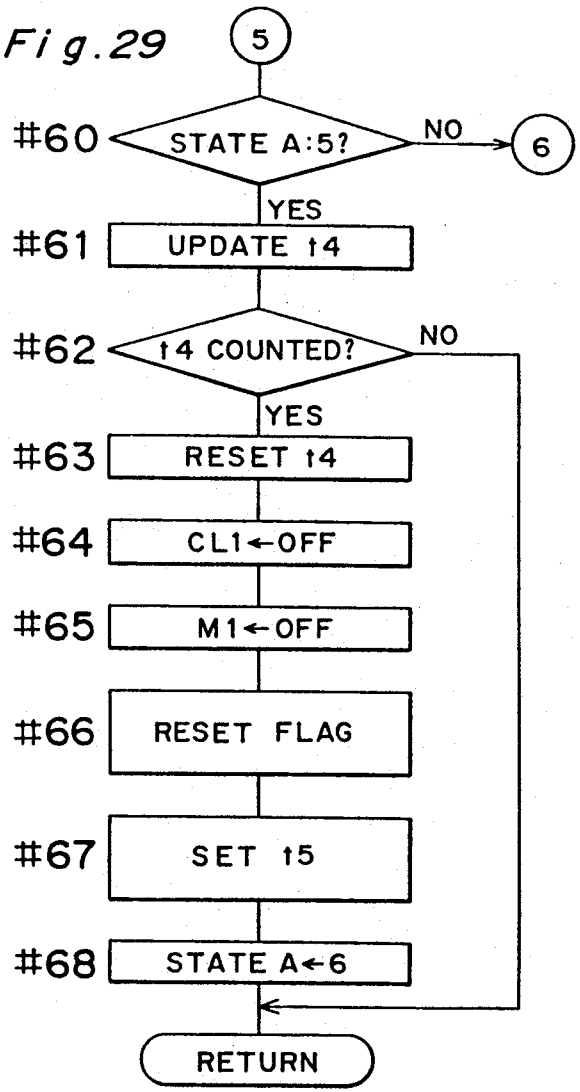
Figure 28:
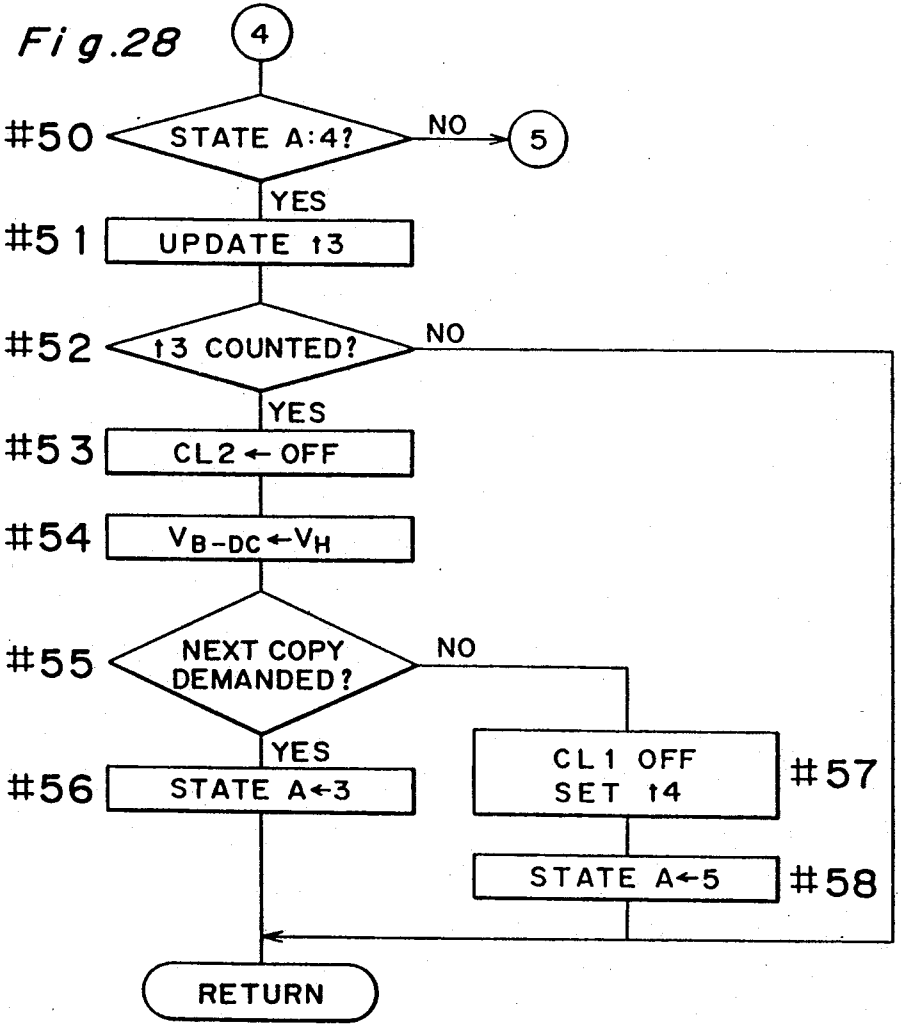

Namely, when the toner density is lower than a predetermined reference density, the motor M2 driven so as to replenish the toner to the toner replenishment section 60. The replenished toner is replenished through the replenishment opening 61 to the second agitator passage 32 with the rotation of the replenishment screw 62, so that the toner density is recovered to proper condition. B. Control For The Development Bias And The Toner Density Referring now to a time chart shown in FIG. 22 and flow charts shown in FIGS. 23 to 32, control for the development bias executed by the CPU is described in detail hereinbelow.

Figure 23:
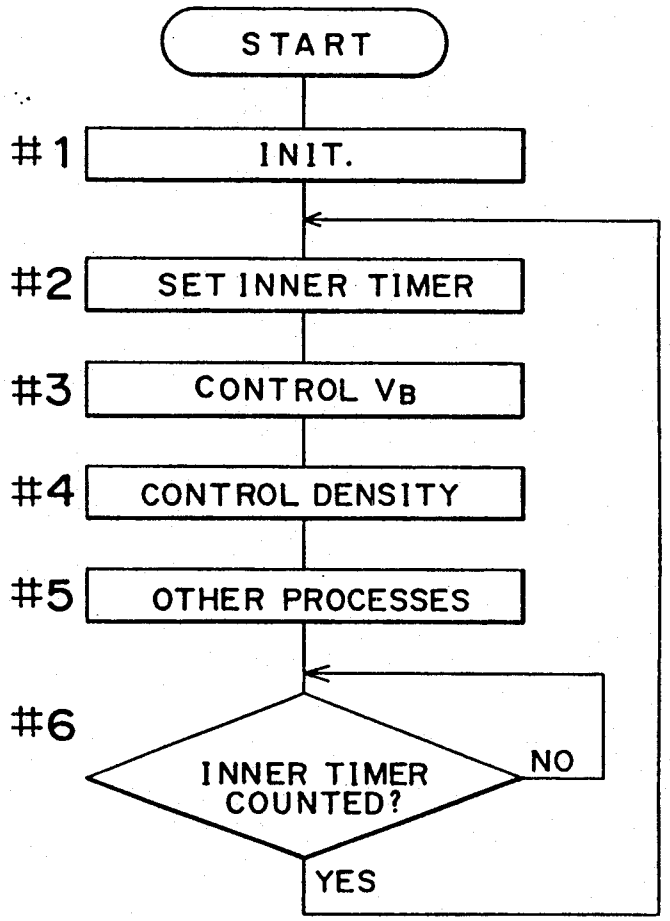
FIG. 23 shows a flow chart of a main routine in the third embodiment of the present invention.

(a) Main Routine (See FIG. 23)

When the copying machine is switched on so as to connect it with an electric power source, a program of the CPU starts, and at step #1, registers and peripheral interfaces are initialized.

At step #2, an inner timer, which defines a time interval of one routine, starts. This time interval becomes a reference for each counting carried out by various timers described below. These timers are updated per program flow passing through the main routine.

At step #3, a process for controlling development bias is executed.

At step #4, a process for controlling a toner density is executed.

At step #5, other processes are executed.

The controls for the development bias and the toner density will be described below in detail.

Finally, at step #6, it is judged whether or not the counting in the inner timer has finished, and in the case of "YES", the program flow returns to step #2 again, while in the case of "NO", the inner timer is started again.

Hereinafter, the above processes are repeated.

(b) Routines for controlling the development bias

The routines for controlling the development bias are described below. i. Control for the development bias (No.1)(See FIG. 24)

In this routine, at step #10, it is judged whether or not state A is "0". This state A is set to one of the values from "0" to "6", corresponding to a state of the control. A present state is judged by checking the value, and the corresponding process is executed.

At step #10, in the case of "YES", step #11 follows, while in the case of "NO", step #20 follows.

At step #11, it is judged whether or not ON edge is detected form the signal. Meanwhile, ON edge means a state in which the signal from the printswitch is changed over from OFF to ON. At step #11, in the case of "NO", the program flow returns to the main routine, while in the case of "YES", the program flow returns to the main routine after the processes of steps #12 to #16 are executed.

At step #12, an output of DC development bias $V_{B\text{-}DC}$ is set to a value of $V_{H-=600}$ V. In this case, AC development bias $V_{B\text{-}AC}$ is set so as to have a peak-peak value of 1200 V.

At step #13, the output of the development bias $V_B(V_{B\text{-}DC}+V_{B\text{-}AC})$ is output, and thus this is applied to the development sleeve 23.

At step #14, the window bias is $V_W(=-1.5$ KV) is output, and thus this is applied to the sensor 50.

At step #15, a timer t1 for securing rise of the window bias is set. This timer t1 is provided to secure a time period for raising the window bias $V_W$ completely, and agitating of the developer is not performed until counting in the timer t1 has finished for the following reason. If the developer is agitated before the window bias $V_W$ rises completely, the developer agitated adheres onto the window 54, resulting in an obstacle for detecting the toner density.

Meanwhile, the driving of the development motor M1 is started at the same time as the output of the development bias $V_B$ and the window bias $V_W$. However, at this time the clutch CLl of the development apparatus facing the photosensitive drum 2 is disconnected. Therefore, the bucket roller 36 and the conveying screw 37 do not rotate.

At step #16, the state A is changed to "1".

ii. Control for the Development Bias(No.2)(See FIG. 25)

At step #20, it is judged whether or not the state A is "1", and in the case of "YES", step #21 follows, while in the case of "NO", step #30 follows.

At step #21, the timer t1 is updated.

At step #22, it is timer t1 judged whether or not the counting in the timer t1 has finished, and in the case of "NO", the program flow returns to the main routine, while in the case of "YES", processes of steps #23 to #26 are executed.

At step #23, the timer t1 is reset.

At step #24, a timer t2 for permitting to detect the toner density is set to a time period required or responding of the clutch CL1 and for making the agitated developer in the development apparatus stable.

At step #25, the clutch CL1 of the development apparatus facing the photosensitive drum 2 is connected. At this time, since the development motor M1 has already driven, the rotation of the motor M1 is transmitted to the bucket roller 36, the conveying screw 37 and the replenishment screw 62 at the same time with the connection of the clutch CL1. Namely, they rotate in the direction of arrows b, c, d, respectively. Thus, the developer in the first agitator passage 31 and the second agitator passage 32 are conveyed through its circulation with their rotation.

At step #26, the state A is changed to "2".

iii. Control for the Development Bias(No.2)(See FIG. 26)

At step #30, it is judged whether or not the state is "2", and in the case of "YES", step #31 follows while in the case of "NO", step #40 follows.

At step #31, the timer t2 is updated.

At step #32, it is judged whether or not counting in the timer t2 has finished, and in the case of "NO", the program flow returns to the main routine, while in the case of "YES", processes of steps #33 to #35 are executed. Meanwhile, at the time when the counting in the timer t2 has finished, a flow of the developer in the passages 31, 32 becomes stable.

At step #33, the timer t2 is reset.

At step #34, a flag for permitting to measure the toner density is set. This flag, by which it is judged whether or not toner density measurement should be carried out, is used in control for the toner density described hereinbelow.

At step #35, the state A is changed to "3".

iv. Control for the Development Bias(No.4)(See FIG. 27)

At step 40, it is judged whether or not the state is "3", and in the case of "NO", step #50 follows, while in the case of "YES", step #41 follows.

At step #41, it is judged whether or not the flag for permitting to form an image exists, and in the case of "NO", the program flow returns to the main routine, while in the case of "YES", processes of steps #42 to #45 are executed. Meanwhile, this flag is used for judging whether or not the sleeve 23 should be rotated.

At step #42, the clutch CL2 is connected so as to transmit the rotation of the motor M1 to the sleeve 23. Thus, the developer retained on the surface of the sleeve 23 is conveyed to a portion facing the photosensitive drum 2, and development of an electrostatic latent image formed on the drum 2 is started.

At step #43, the DC development bias $V_{B\text{-}DC}$ is changed to a value $V_L = -400$ V. On the other hand, AC development bias $V_{B\text{-}AC}$ is unchanged.

At step #44, a sleeve-off timer t3 is set. This timer t3 is provided to determine a time period of rotation of the sleeve 23 required to form the image, and during counting in this timer t3, the development is executed.

At step #45, the state A is changed to "4".

v. Control for the Development Bias(No.5)(See FIG. 28)

At step #50, it is judged whether or not the state A is "4", and in the case of "NO", step #60 follows, while in the case of "YES", step #51 follows.

At step #51, the timer t3 is updated.

At step #52, it is judged whether or not counting in the timer t3 has finished, and in the case of "NO", the program flow returns to the main routine, while in the case of "YES", step #53 follows.

At step #53, the clutch CL2 is disconnected, and the rotation of the sleeve 23 is stopped.

At step #54, DC development bias $V_{B\text{-}DC}$ is changed to a value $V_H = -600$ V.

At step #55, it is judged whether or not the next copy is demanded, and in the case of "YES", step #56 follows, and the state A is changed to "3", thereafter the development is executed again. While, at step #55, in the case of "NO", step #57 follows.

At step #57, an off timer t4 for the clutch CL1 is set.

At step #58, the state A is changed to "5". This timer t4 is provided to secure a time for replenishment of a toner to the replenishment apparatus, and stabilization of the toner after finishing the development.

vi. Control for the Development Bias(No.6)(See FIG. 29)

At step #60, it is judged whether or not the state A is "5", and in the case of "NO", step #70 follows, while in the case of "YES", step #61 follows.

At step #61, the timer t4 is updated.

At step #62, it is judged whether or not counting in the timer t4 has finished, and in the case of "NO", the program flow returns to the main routine, while in the case of "YES", processes of steps #63 to #68 are executed.

At step #63, the timer t4 is reset.

At step #64, the clutch CL1 is disconnected, and thus transmission of driving force from the motor M1 to the bucket roller 36 etc. is cut off, and agitation and conveyance for the developer are stopped.

At step #65, the rotation of the motor M1 is stopped.

At step #66, the flag is reset, so that the measurement of the toner density is stopped.

At step #67, an off timer t5 for the window bias is set. This timer t5 is provided to secure a time period for the bucket roller 36 and the conveying screw 37 rotating by inertia to be stopped completely after the clutch CL1 and the motor M1 are stopped.

At step #68, the state A is changed to "6".

vii. Control for the Development Bias(No.7)(See FIG. 30)

At step #70, the timer t5 is updated.

At step #71, it is judged whether or not counting in the timer t5 has finished, and in the case of "NO", the program flow returns to the main routine, while in the case of "YES", processes of the steps #72 to #75 are executed.

At step #72, the timer t5 is reset.

At step #73, the output of the window bias $V_W$ is stopped.

In this way, the output of the window bias $V_W$ is stopped after the motor M1 and the clutch CL1 are stopped, and counting in the timer t5 has finished, and the bucket roller 36 and the conveying screw 37 are stopped completely. Accordingly, the developer does not adhere onto the detection window 54 of the sensor 50, and thus the detection window 54 is maintained in clean condition.

At step #74, the output of the development bias $V_B$ is stopped.

At step #75, the state A is changed to "0".

As described above, in this routine for controlling the development bias, DC development bias $V_{B\text{-}DC}$ is set to a value $V_L = -400$ V, during development period in which the sleeve 23 is rotating. In addition, in the non-development period in which the bucket roller 36 and the conveying screw 37 are rotating, DC development bias $V_{B\text{-}DC}$ is set to a value $V_H = -600$ V.

Therefore, under the condition in which a charge of the developer tends to change to positive polarity, and even if an electric field between the electrode 41 and the detection window 54 has changed by imperfectly grounded electrode 41, at least adhesion of the carrier onto the detection window 54 is prevented by the following reasons.

If the control for the development bias $V_B$ described above is not executed, in the development apparatus, the carrier adheres onto the detection window 54 in the following way.

Namely, the electrode 41 facing the sensor 50 is grounded by the shaft 38 being brought into contact with the terminal 49*a* which is fitted into the recess portion 47 of the shaft 38 of the conveying screw 37. However, since the shaft 38 is a rotary member, both of them are worn away, at contact portions between the shaft 38 and the terminal 49*a*. Further, the developer leaking out from the development apparatus invades into their contact portions, an electrical connection between the shaft 38 and the terminal 49a may be intercepted. Actually, in an apparatus adopting an electrical connection similar to those, imperfect connection often occurred.

If the electrical connection between the shaft 38 and the terminal 49a is intercepted, the electrode 41 becomes electrically floating.

In this case, each of the toner and the carrier conveyed in the first and second agitator passages 31, 32, has a charge having negative or positive polarity, respectively, and usually their charged amount is equalized with each other. However, if a lot of the toner charged to negative polarity is consumed, the developer is charged positively, as a whole. Especially, this phenomenon is likely to take place, when a humidity is low, or the developer is fresh.

If these positive charges move to the electrode 41 floating electrically, the electric field between the detection window 54 and the electrode 41 varies. Namely, although potential difference between the detection window 54 and the electrode 41 is 1.5 V in the case that the window bias $V_W$ is $-1.5$ V when the electrode 41 is grounded, if the electrode 41 is charged positively, the potential difference becomes larger.

As a result, as is clear from FIG. 21, the carrier adheres onto the detection window 54.

If the carrier adheres onto the detection window 54, it is judged on the basis of the signal from the sensor 50, because of lower reflectance of the carrier than that of the toner, that the toner in the developer is lacking. Thus, the toner is replenished to the development apparatus, and the real amount of the toner contained in the developer becomes more than a suitable amount, resulting in toner falling from the development apparatus because of excess condition of the toner.

On the contrary, there is not such a problem in the apparatus of the present invention having the above described controller.

Namely, during the non-development period, and when the window bias $V_W$ is applied, DC development bias $V_{B\text{-}DC}$ is set to a high value $V_H = -600$ V. As a result, even if the developer is positively charged by consuming a lot of toner etc., the developer is neutralized electrically by a charge, which has negative polarity of DC development bias $V_{B\text{-}DC} = -600$ V, being mixed into the developer.

Accordingly, even if the electrode 41 becomes electrically floating by being imperfectly grounded under a condition in which the developer is likely to be positively charged by consuming a lot of the toner, or by a variation of humidity, the carrier does not adhere onto the detection window 54 of the sensor 50, resulting in correct detection of the toner density because the developer is neutralized as a whole.

Meanwhile, although the electric power source 25a for the development bias $V_B$ includes the electric power source 27 for DC development bias and the electric power source 28 for AC development bias such that a voltage, which is a sum of DC voltage and AC voltage, is applied to the sleeve 23 in the above described embodiment. The electric power source 25a may include only a DC electric power source. However, by using an AC electric power source together with a DC electric power source, mixing of the charge into the developer is carried out more quickly.

(c) Sub-routines for Controlling the Toner Density

Figure 32:
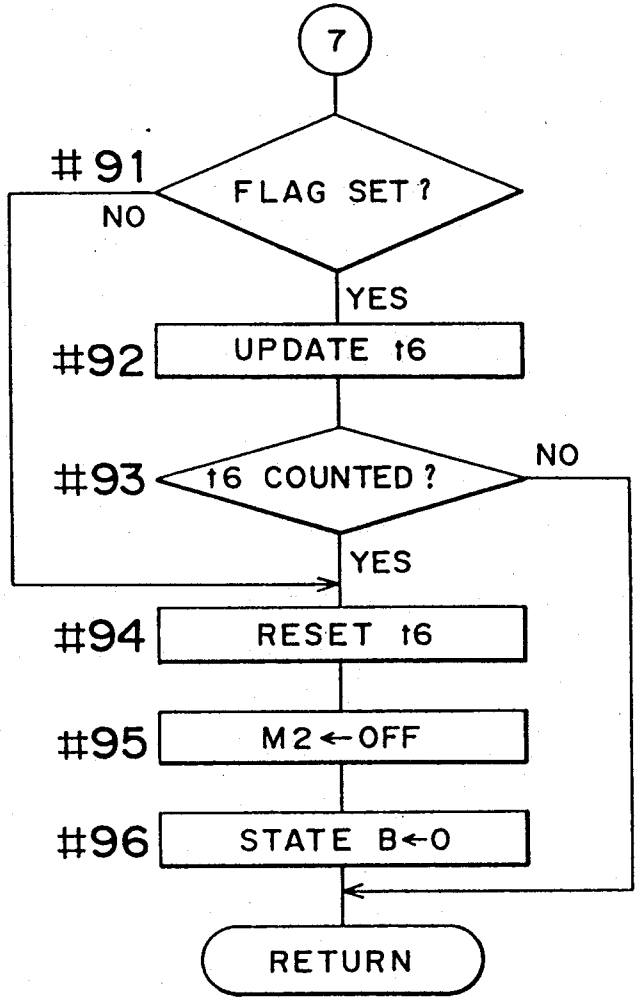
FIGS. 31 and 32 show flow charts regarding the control for the toner density in the third embodiment of the present invention.
Figure 30:
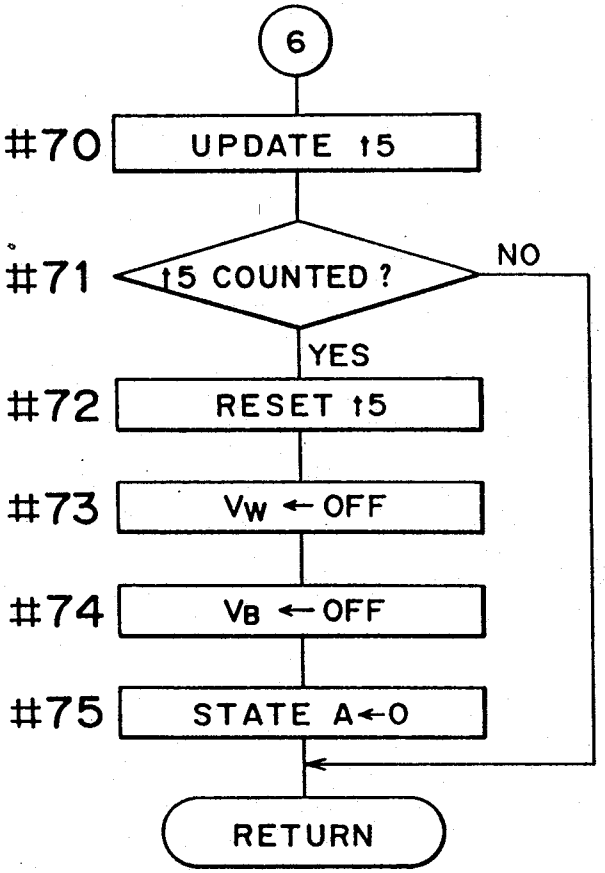
Figure 31:
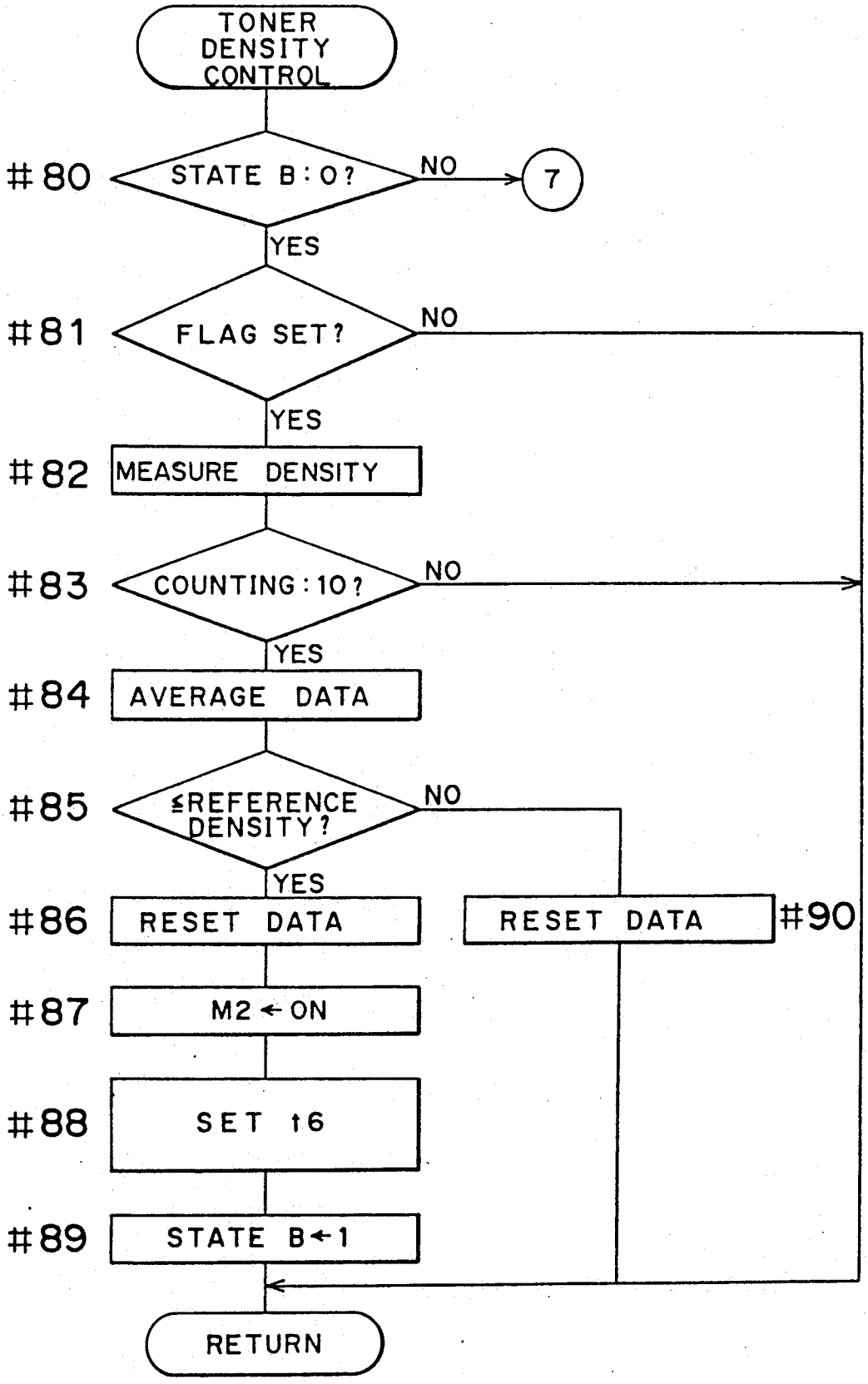

Referring to FIGS. 31 to 32, sub-routines for controlling the toner density are described hereinbelow. i. Control for the toner density(No.1)(See FIG. 31)

At step #80, it is judged whether or not the state B is "0". This state B is set to "0" or "1". When the copying machine is switched on, this state B is set to "1" at initial setting routine.

At step #81, it is judged whether or not the flag for permitting detection of the toner density is set, and in the case of "YES", step #82 follows. This flag is set at step #34.

At step #82, data from the sensor 50 are sampled.

At step #83, it is judged whether or not ten data are sampled, and in the case of "NO", the program flow returns to the main routine, while in the case of "YES", step #84 follows.

At step #84, ten sampled data are averaged.

At step #85, the averaged data is compared with a reference density, if the measured toner density is higher than the reference density, step #90 follows, and the data of the toner density are reset.

While, if the measured toner density is lower than the reference density at step #85, the processes of steps #86 to #89 are executed.

At step #86, the data of the toner density are reset.

At step #87, the motor M2 is driven.

At step #88, a timer t6 for replenishing the toner is set, thereby the development of a corresponding color is replenished to the development apparatus from the toner hopper 15.

At step #89, the state B is changed to "1". ii. Control for the toner density(No.2)(See FIG. 32)

At step #91, it is judged whether or not the flag is set, and in the case of "YES", step #92 follows.

At step #92, the timer t6 is updated.

At step #93, it is judged whether or not counting in the timer t6 has finished, and in the case of "NO", the program flow returns to the main routine, while in the case of "YES", step #94 follows after stopping the replenishment of the toner.

On the other hand, in the case of "NO" at step #81, step #94 follows.

At step #94, the timer t6 is reset.

At step #95, it is stopped to replenish the toner from the toner hopper 15.

At step #96, the state B is changed to "0".

Meanwhile, although the bias is applied to the electrically conductive film such that the detection window 54 has a polarity identical with that of the charged toner in this embodiment, it may also make the window portion by a material which is charged to same polarity as that of the charged toner by friction between the material and the toner.

Since other constructions and operations of the apparatus according to this embodiment of the invention are the same as those of the apparatus according to the afore-mentioned embodiment of the invention, description thereof is abbreviated for the sake of brevity.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. Apparatus for measuring developer density comprising:

a container containing a developer constituted by a toner and a carrier;

a rotary member agitating said developer in said container with its rotation;

a transparent detection window facing said container and having an electrically conductive film on its surface facing said developer;

a measuring section measuring said developer density in said container on the basis of reflected light from said developer illuminated through said detection window;

an electrode which is supported by said rotary member, and is rotated together with said rotary member such that a gap between said electrode and said detection window is maintained at a predetermined value;

said electrode being made, at least at one portion facing said detection window, of electrically conductive material;

at least one magnet which is supported by said electrode, and which retains said developer, so that said magnet causes said developer to be brought into contact with said detection window with said rotation of said rotary member; and a bias application member for applying bias between said detection window and said electrode so as to make said detection window and said toner electrically repulsive to each other.

2. Apparatus as claimed in claim 1 wherein a damming wall is provided at one end of said detection window facing said rotary member and downstream in a direction of said rotary member.

3. Apparatus for measuring developer density comprising:

a container containing a developer constituted by a toner and a carrier;

a rotary member agitating said developer in said container with its rotation;

a transparent detection window facing said container and having an electrically conductive film on its surface facing said developer;

a measuring section measuring said developer density in said container on the basis of reflected light from said developer illuminated through said detection window;

a magnet, which is supported by an electrode, and which retains said developer, so that said magnet causes said developer to be brought into contact with said detection window with said rotation of said rotary member; and an electric power source applying bias having a polarity identical with that of a charged toner to said film through the electrode;

said electrode being disposed in a region in which said electrode does not interfere with said developer retained on said magnet.

4. Development apparatus containing a developer constituted by a toner and a carrier, and supplying a toner to a member to be developed corresponding to a potential difference between a potential at a surface of said member to be developed and development bias comprising:

a) a passage for containing and conveying said developer;

b) a transparent detection window facing said passage and being constructed to be charged to a polarity identical with that of charged toner so as to prevent adhesion of said toner onto a surface of said window facing said developer;

c) a rotary member being disposed rotatably in said passage, and having a magnet and an electrode grounded at a portion facing said window;

d) a device for measuring said developer density on the basis of reflected light from said developer illuminated through said window; and e) a means for setting a development bias such that said development bias negates a charge of said carrier during non-development period and at least said rotary member is rotating.

* * * * *